US011940241B2

(12) United States Patent
Ma et al.

(10) Patent No.: US 11,940,241 B2
(45) Date of Patent: Mar. 26, 2024

(54) DRUM-FED TOY PROJECTILE LAUNCHER WITH RADIALLY STACKED PROJECTILES IN DRUM

(71) Applicant: Buzz Bee Toys, Inc., Mt. Laurel, NJ (US)

(72) Inventors: Chor-Ming (Ken) Ma, Mt. Laurel, NJ (US); Brownie Johnson, Mt. Laurel, NJ (US)

(73) Assignee: Buzz Bee Toys, Inc., Mt. Laurel, NJ (US)

( * ) Notice: Subject to any disclaimer, the term of this patent is extended or adjusted under 35 U.S.C. 154(b) by 0 days.

(21) Appl. No.: 17/944,258

(22) Filed: Sep. 14, 2022

(65) Prior Publication Data

US 2023/0079588 A1 Mar. 16, 2023

Related U.S. Application Data

(60) Provisional application No. 63/243,781, filed on Sep. 14, 2021.

(51) Int. Cl.

| | |
|---|---|
| ***F41B 11/54*** | (2013.01) |
| ***A63F 9/02*** | (2006.01) |
| ***F41A 9/26*** | (2006.01) |
| ***F41A 9/73*** | (2006.01) |
| ***F41B 11/55*** | (2013.01) |
| *F41A 9/24* | (2006.01) |

(52) U.S. Cl.

CPC ..... *F41B 11/54* (2013.01); *A63F 9/0278* (2013.01); *F41A 9/26* (2013.01); *F41A 9/73* (2013.01); *F41B 11/55* (2013.01); *A63F 9/0252* (2013.01); *A63F 2009/0282* (2013.01); *F41A 9/24* (2013.01)

(58) Field of Classification Search

CPC ..... F41A 9/73; F41A 9/26; F41A 9/24; F41A 9/27; F41A 9/28; F41B 11/54; F41B 11/55; F41B 7/006

USPC ..... 124/48

See application file for complete search history.

(56) References Cited

U.S. PATENT DOCUMENTS

| | | | | |
|---|---|---|---|---|
| 2,615,369 | A * | 10/1952 | Jansson | F41A 9/49 89/33.02 |
| 9,958,230 | B1 * | 5/2018 | Nugent | F41A 9/65 |
| 10,495,406 | B1 * | 12/2019 | Ma | F41B 11/54 |
| 10,533,821 | B2 | 1/2020 | Chia | |

(Continued)

*Primary Examiner* — John E Simms, Jr.

(74) *Attorney, Agent, or Firm* — Volpe Koenig

(57) ABSTRACT

A toy launcher with a drum magazine assembly that has a rotatable drum portion mounted for rotation, with a rear plate and a central support with an opening for a support axle. A ring of projectile holders is connected to the rear plate, with each projectile holder holding at least two projectiles arranged in a generally radially stacked configuration. Generally radially extending walls are located between adjacent projectile holders. Each of the projectile holders includes a slot on a radially inner side into which a projectile biasing arm extends at a projectile launch position. A pusher is located in the housing adjacent to the projectile launch position. Drive wheels are positioned in front of the drum magazine assembly at the projectile launch position. The drive wheels are motorized so that they rotate to propel a projectile pushed from the drum between the drive wheels for launching the projectile.

14 Claims, 22 Drawing Sheets

(56) References Cited

U.S. PATENT DOCUMENTS

| | | | | |
|---|---|---|---|---|
| 2003/0075038 | A1* | 4/2003 | Eriksson | F41A 9/73<br>89/33.02 |
| 2013/0312726 | A1* | 11/2013 | Mead | F41A 9/74<br>124/78 |
| 2015/0233666 | A1* | 8/2015 | Rodich | F41B 5/126<br>124/52 |
| 2016/0018173 | A1* | 1/2016 | Lallier | F41B 11/54<br>124/48 |
| 2016/0102931 | A1* | 4/2016 | Roberts | F41A 9/75<br>89/33.02 |
| 2019/0113303 | A1* | 4/2019 | Johnson | F41B 11/55 |
| 2019/0383575 | A1* | 12/2019 | Chia | A63F 9/0278 |
| 2021/0095935 | A1* | 4/2021 | Chia | F41B 11/54 |

* cited by examiner

DRUM-FED TOY PROJECTILE LAUNCHER WITH RADIALLY STACKED PROJECTILES IN DRUM

INCORPORATION BY REFERENCE

The following documents are incorporated herein by reference as if fully set forth: U.S. Provisional Patent Application No. 63/243,781, filed Sep. 14, 2021.

FIELD OF INVENTION

The disclosure relates to a toy projectile launcher, such as a toy dart launcher, with a high capacity drum magazine.

BACKGROUND

Toy launchers that discharge soft projectiles, such as toy foam darts or toy foam balls, commonly referred to as toy "launchers" are known. The toy projectiles are designed to safely impact upon a target without causing injury or damage.

Toy launchers may use one of various different mechanisms for launching the projectiles. One known mechanism for launching toy projectiles from a toy launcher involves the application of compressed air on the projectiles to launch them. Specialized valving is required to control the compressed air to only be directed at the projectile that is intended to be launched at a particular time. Specialized safety requirements must also be met for the compressed gas reservoir.

Another known mechanism to launch toy projectiles is to feed the toy projectiles using a pusher mechanism into contact one or more rotating wheels to propel the projectiles forward toward a target.

Known launchers use a variety of different types of magazines for toy darts. One known magazine is in the form of a clip or cartridge that feeds darts to a launching mechanism of the launcher. Another type of magazine holds the darts and advances the darts to firing position with a biasing spring when released upon activation of a trigger. However, there are size and capacity limitations with straight clips or magazines.

The size limitation with straight magazines has led to the use of circular drum-type magazines.

One known launcher includes a drum that has a single ring of toy dart holders arrayed around the drum. This launcher launches the darts with motorized wheels positioned in front of the drum and darts are pushed one at a time from the drum to the flywheels for launch. One drawback of this launcher is the number of darts that can be arranged a single ring of darts at the periphery of drum which, while an increase from the straight magazines or clips, is limiting based on the overall practical size of a toy projectile launcher.

To address this, other known projectile launchers with a drum-type magazine have two concentric rings of darts in the drum, and the toy darts are launched sequentially first from one ring and, after all of the darts in one ring are launched, then the darts in the other ring are launched. This launcher has a more complex launch mechanism as it requires switching between launching from one ring to the other ring.

Another known projectile launcher is described in U.S. Pat. No. 10,533,821, which is incorporated herein by reference as if fully set forth, has a drum-type magazine with two concentric rings of projectiles that are circumferentially offset from one another, and two push rods to alternately push a dart from the respective inner and outer concentric ring into flywheels that are sized to be tall enough to receive darts from both the inner and outer concentric rings. However, the "barrel" has to be oversized as the darts are launched from two different heights, which can cause inconsistencies in performance.

What is needed is an improved toy launcher with a drum-type magazine having multiple concentric rings of darts where the overall performance is enhanced.

SUMMARY

In one aspect, the present disclosure is directed to a toy launcher for launching projectiles, such as soft-tipped foam darts. The toy launcher includes a housing with a drum magazine assembly mounted to the housing. The drum magazine assembly has a rotatable drum portion mounted to rotate with respect to the housing, with a rear plate and a central support on the rear plate, with the central support having an opening for a support axle. A ring of projectile holders is connected to the rear plate, with each said projectile holder configured to hold at least two projectiles arranged in a generally radially stacked configuration. Generally radially extending walls are located between adjacent ones of the projectile holders. Each of the projectile holders including a slot on a radially inner side thereof. A fixed front cover is mounted to the housing and located in front of the projectile holders. A projectile biasing arm is mounted to the fixed front cover at a position at least partially within the drum. The projectile biasing arm extends into the slots on the radially inner side of the projectile holders at a projectile launch position of the rotatable drum portion. A pusher is located in the housing adjacent to the projectile launch position of the rotatable drum portion. One or more drive wheels are positioned in the housing in front of the drum magazine assembly at the projectile launch position. At least one motor is connected to the drive wheels. The drive wheels are configured to rotate upon the at least one motor being activated to propel at least one of the projectiles when pushed by the pusher from the drum toward the one or more drive wheels for launching the at least one of the projectiles out of the toy launcher.

In one preferred arrangement, the generally radially extending walls located between adjacent ones of the projectile holders are angled between 2 and 30 degrees from a radial direction through a center of the drum. More preferably, the walls are angled between 10 and 20 degrees. Most preferably, the walls are angled at about 15 degrees.

Preferably, the rotatable drum portion is configured to rotate in a same direction as an orientation of inner ends of the generally radially extending walls.

In one arrangement, each of the projectile holders includes two of the slots on the radially inner side thereof, and the projectile biasing arm includes two arm portions that extend into the slots on the radially inner side of the projectile holders at the projectile launch position. The projectile biasing arm is preferably pivotably mounted to the front cover, and the two arm portions extend away from a location of the pivotable mounting in a direction of rotation of the drum.

In one arrangement, the one or more drive wheels includes two drive wheels positioned in the housing in front of the drum magazine assembly at the projectile launch position. Preferably, each of the drive wheels is driven by a separate electric motor.

In one arrangement, a trigger is movably connected to the housing, such that activation of the trigger causes an incremental rotation of the drum and activates the pusher to push a pushing rod that is in alignment with a respective one of the projectile holders in the projectile launch position to mechanically push an outermost of the projectiles, that is biased radially outwardly by the projectile biasing arm acting on the outermost projectile or on a radially inner one of the projectiles in the respective one of the projectile holders that is located radially inwardly from the outermost projectile when loaded in the respective one of the projectile holders, to engage with the one or more drive wheels to launch the first projectile.

In one arrangement, a drum advancement arm configured for reciprocal movement and including a drive surface one end is provided, and the rear plate of the rotatable drum portion includes an arrangement of cam slots. The drive surface of the drum advancement arm is engageable in the cam slots to incrementally advance the drum in a circumferential direction in order to bring a next-adjacent one of the projectile holders into the projectile launch position.

Preferably, the rotatable drum portion is configured to complete a full revolution while launching an outermost one of the projectiles from each of the projectile holders prior to radially inner ones of the projectiles in the projectile holders being moved radially outwardly by the projectile biasing arm at the projectile launch position for launching during a subsequent revolution of the drum.

In one arrangement, the drum advancement arm is motor-driven, and the motor is activated by the trigger.

In one alternative arrangement, each of the projectile holders is configured to hold three projectiles arranged in a generally radially stacked configuration.

In a preferred arrangement, the projectiles are toy darts. However, other types of projectiles, such as balls could be used and launched by the toy launcher.

In one arrangement, the drum magazine assembly is non-removable from housing. Alternatively, the drum magazine assembly or the rotatable drum portion could be removably mounted via removable retainer clips used to mount the drum axle, with the drum axle being slidably removable in an axial direction if a retainer clip is removed from one end, allowing the rotatable drum portion to drop radially out of its position in the housing.

In a preferred arrangement, the plurality of projectile holders are adapted to hold toy darts in a generally radially stacked configuration, with the dart bodies being generally parallel to one another and oriented in a firing direction of the toy launcher.

It is noted that various ones of the above-noted features can be used alone or in combination with one another.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION

Figure 1:
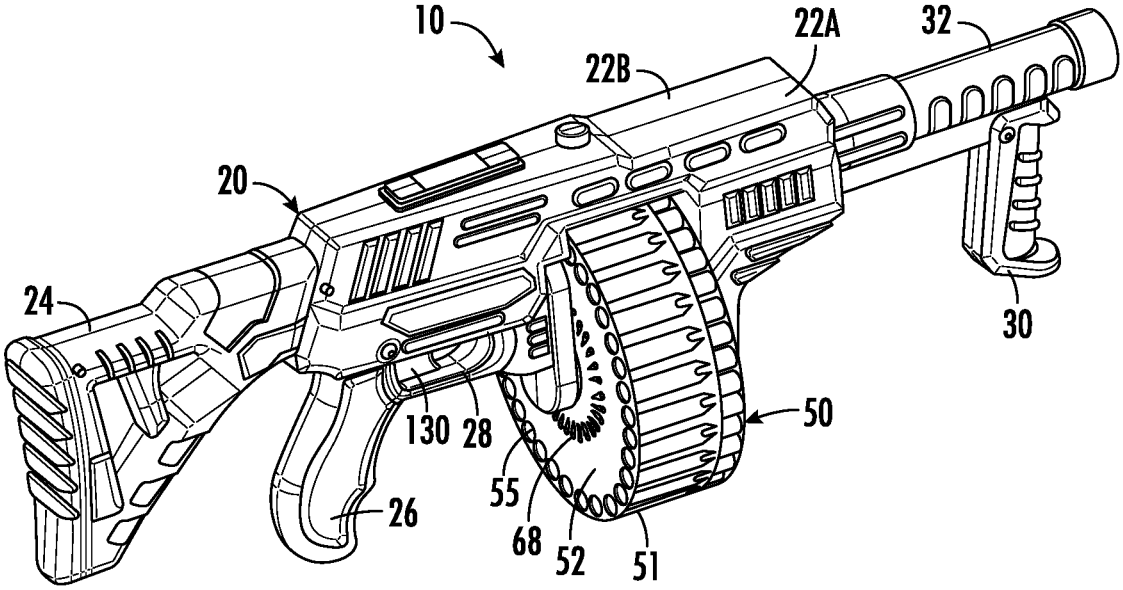
FIG. 1 is a top, right, rear perspective view of a toy launcher in accordance with a first embodiment of the disclosure.
Figure 2:
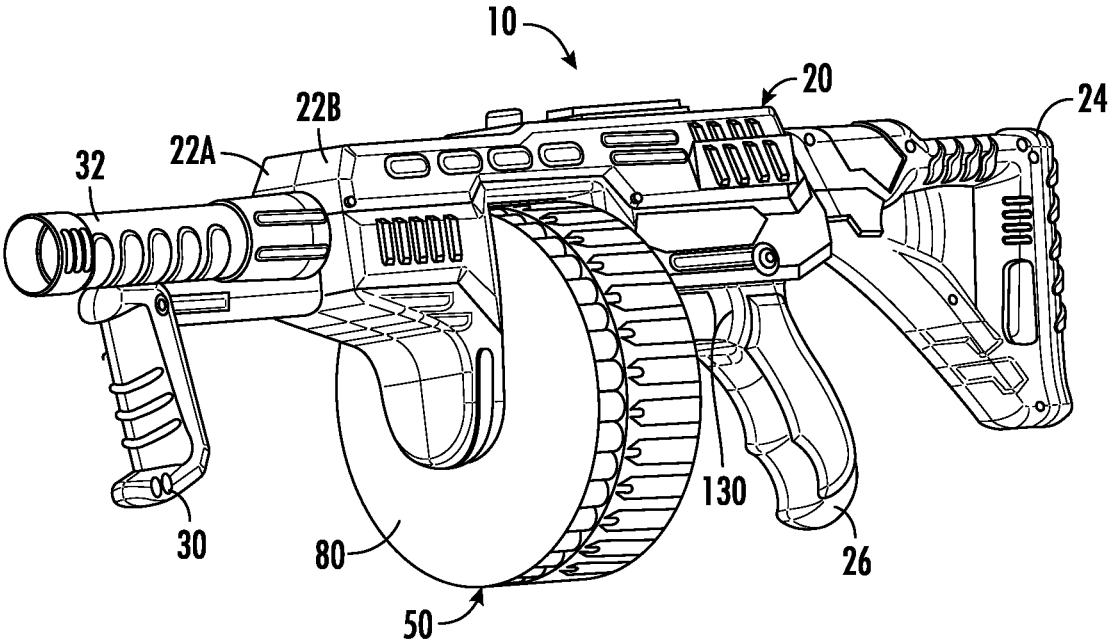
FIG. 2 is a bottom, front, left perspective view of the toy launcher of FIG. 1.
Figure 3:
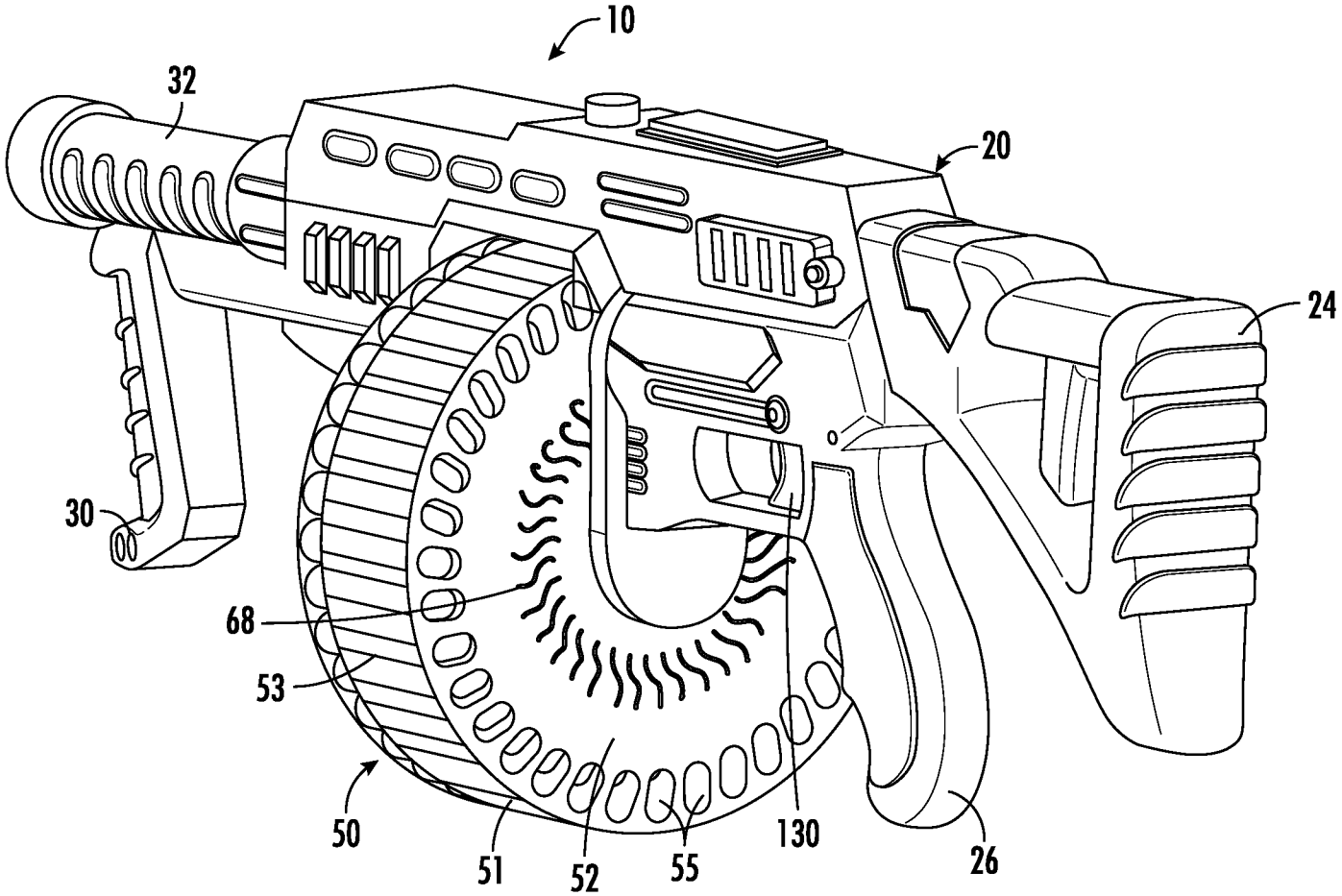
FIG. 3 is a top, left, rear perspective view of the toy launcher of FIG. 1.

Certain terminology is used in the following description for convenience only and is not limiting. The words "inwardly" and "outwardly" refer to directions toward and away from the parts referenced in the drawings. A reference to a list of items that are cited as, for example, "at least one of a or b" (where a and b represent the items being listed) means any single one of the items a or b, or a combination of a and b thereof. This would also apply to lists of three or more items in like manner so that individual ones of the items or combinations thereof are included. The terms "about" and "approximately" encompass + or −10% of an indicated value unless otherwise noted. The term "generally" in connection with a radial direction encompasses +/−25 degrees. The terminology includes the words specifically noted above, derivatives thereof and words of similar import.

Figure 4:
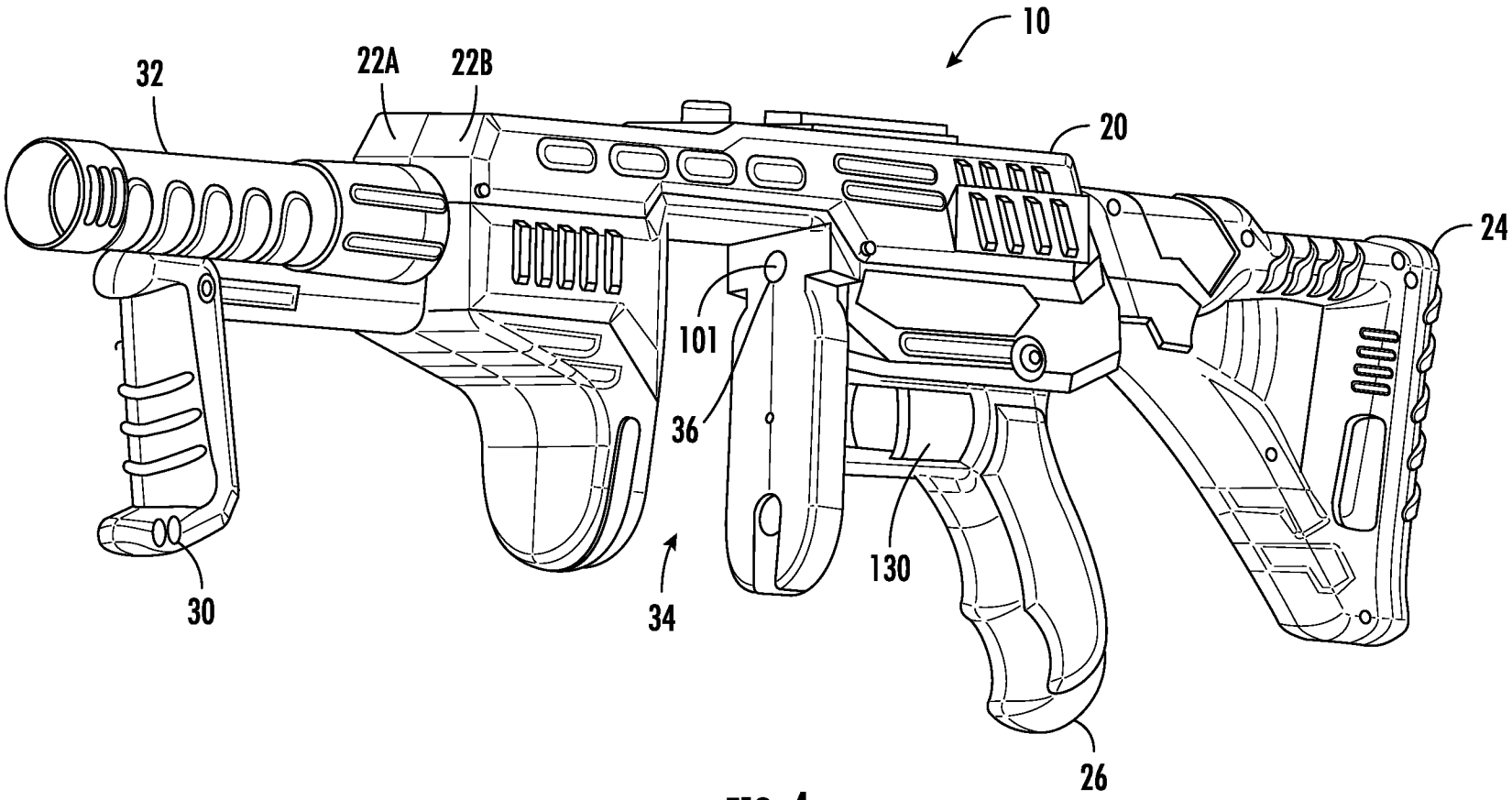
FIG. 4 is a bottom, front, left perspective view of the toy launcher with the drum magazine assembly removed.
Figure 7:
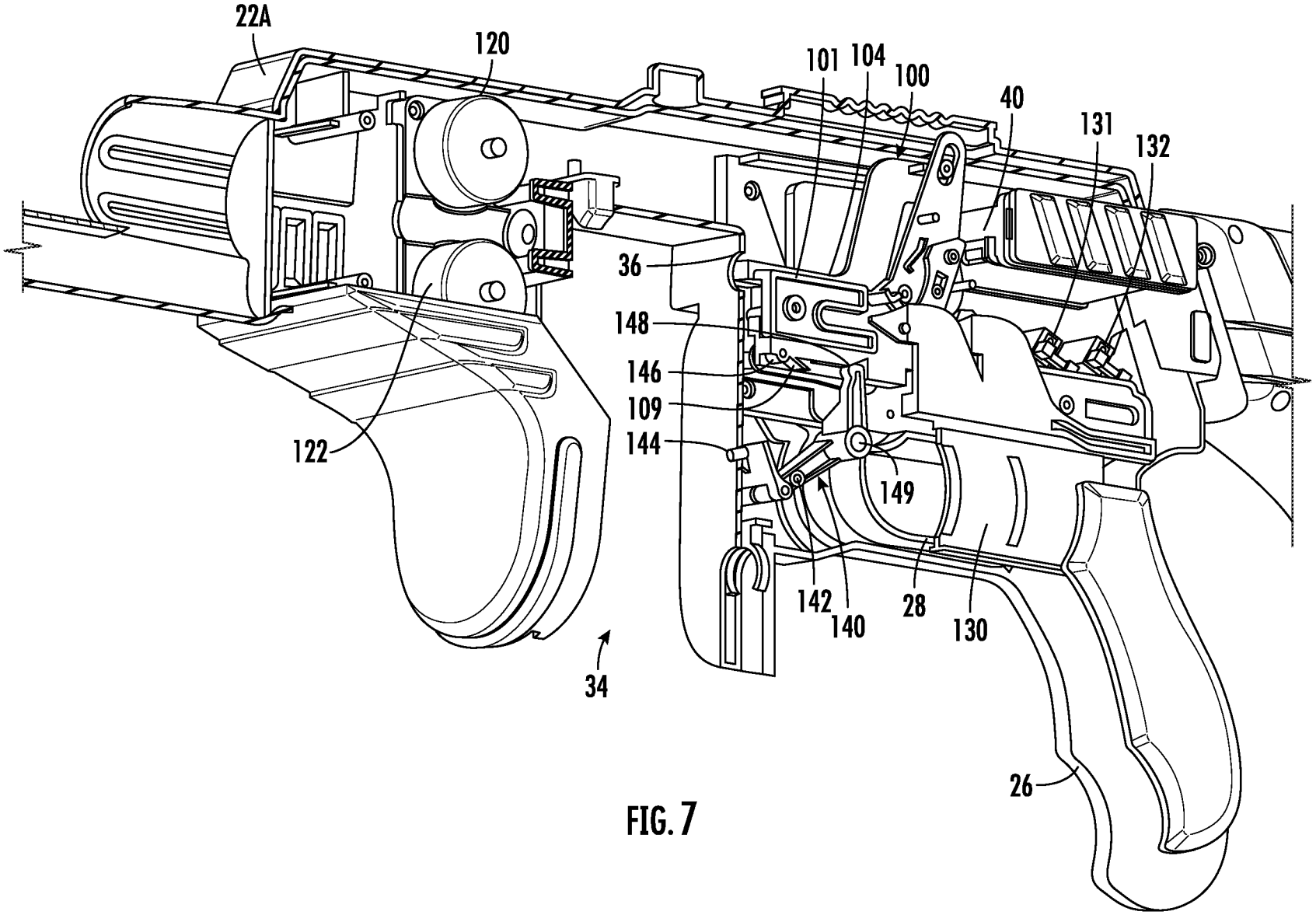
FIG. 7 is an enlarged left side perspective view with the left housing half removed showing the pusher mechanism, the drum advance mechanism, and the launching drive wheels.
Figure 8:
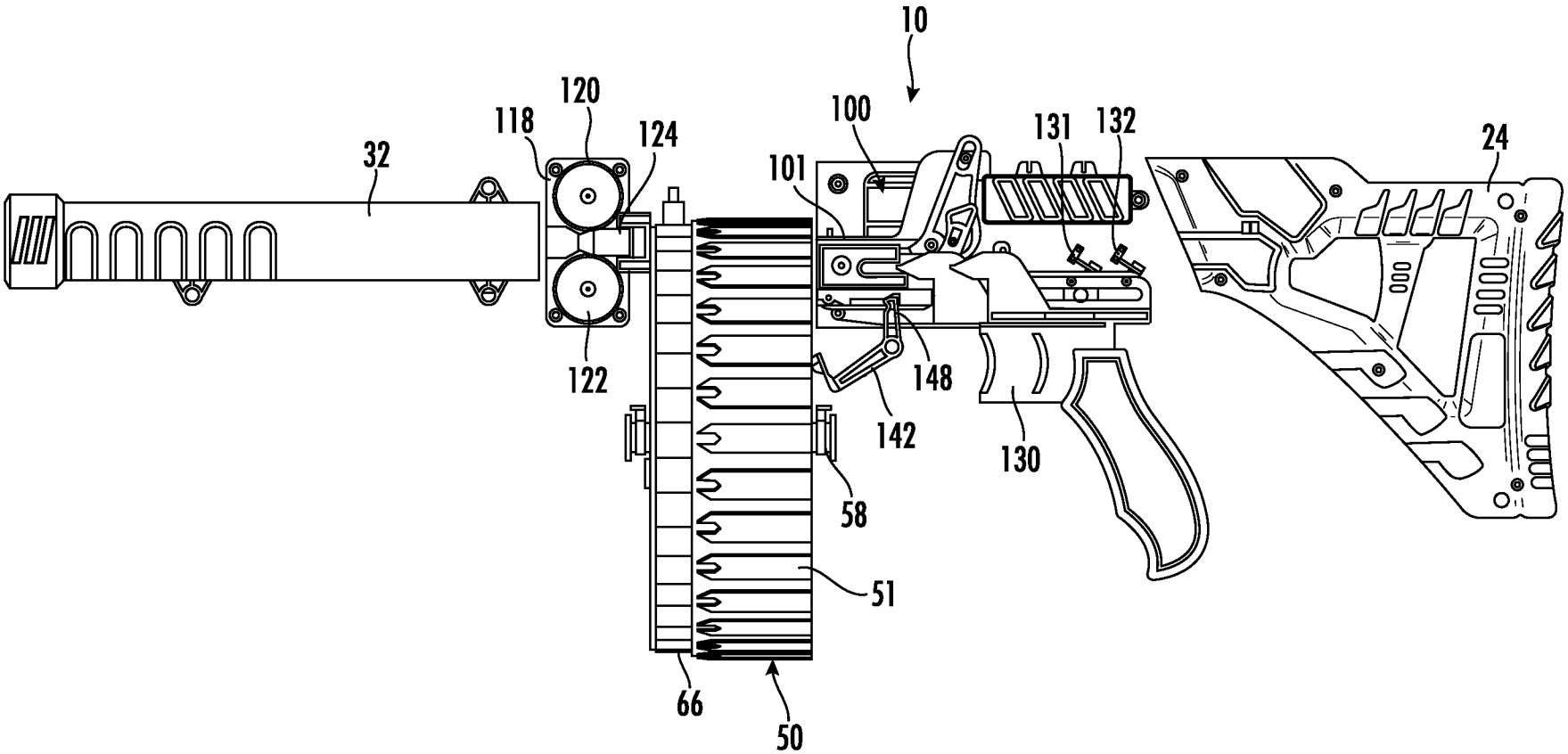
FIG. 8 is a left side view of the internal components without the housing.
Figure 9:
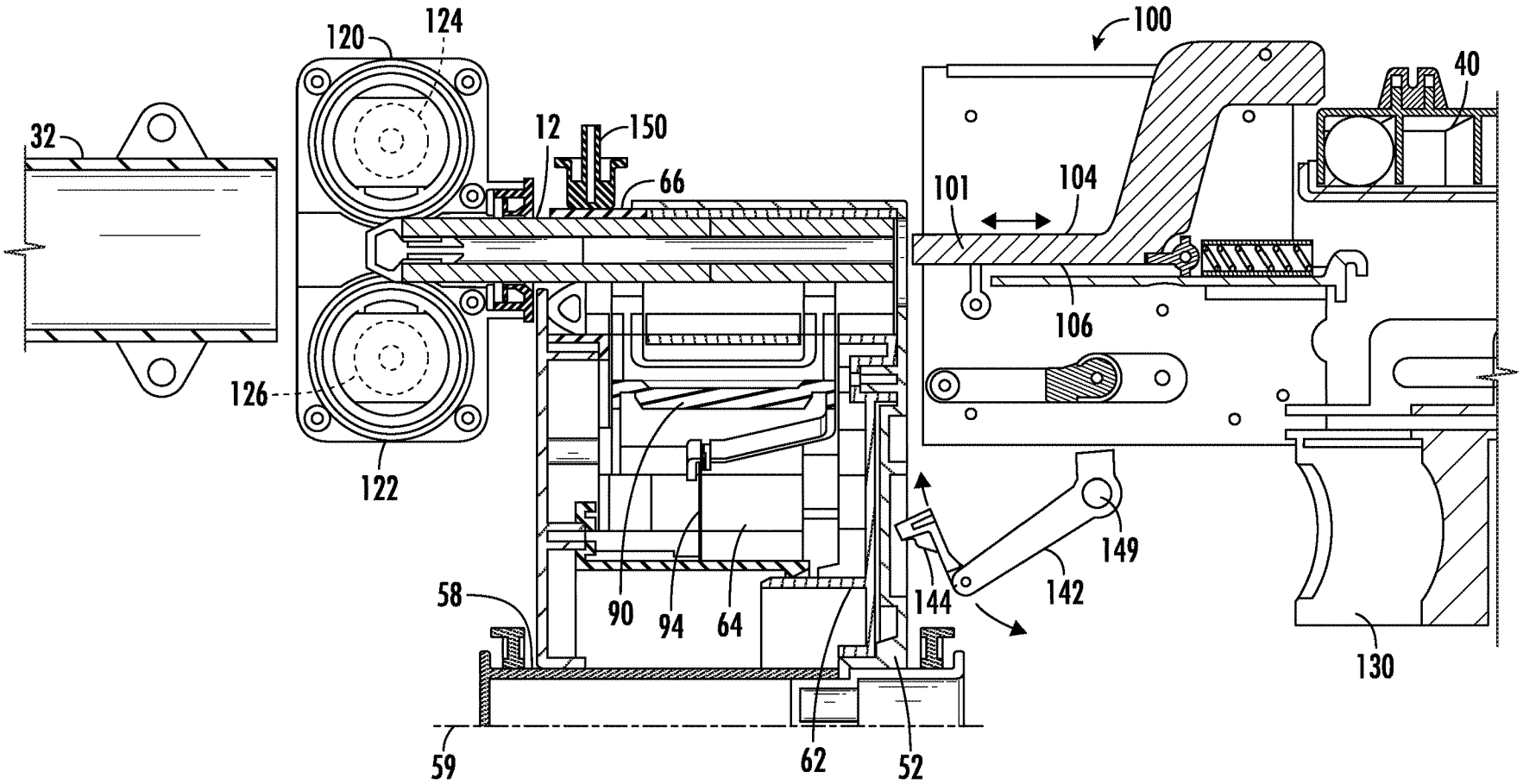
FIG. 9 is an enlarged view, in cross-section, of the pusher assembly, the drum advance mechanism, and the drive wheels used for launching the toy projectiles.

Referring to FIGS. 1-10, a toy launcher 10 for launching projectiles 12, such as foam darts, is shown. The toy launcher 10 includes a housing 20, preferably formed of two housing halves 22A, 22B along with a rear stock 24, a pistol grip 26, a trigger guard 28, as well as a front handle 30 located below a barrel 32. A trigger 130, described in more detail below, is located within the trigger guard 28. As best shown in FIGS. 4 and 7, a drum receiving space 34 is provided in front of the trigger guard 28 and behind the barrel 32 in the firing direction. A drum magazine assembly 50 mounted to the housing and is adapted to hold a plurality of toy projectiles 12, preferably in the form of darts, although other projectiles such as balls could be used.

The housing halves 22A, 22B, the rear stock 24, the pistol grip 26, the trigger guard 28, the front handle 30, as well as the barrel 32 are preferably all made of injection molded plastic. However, other materials could be used. The active components, described below, are preferably assembled inside the two housing halves 22A, 22B and then the housing halves 22A, 22B are connected together. Further decorative accessories may be formed in or connected to the housing halves 22A, 22B, one preferred arrangement of which is shown in the drawings. However, other specific forms could be provided. Further, the rear stock 24 is optional and other forms of the toy launcher 10 do not require a rear stock.

A first embodiment of the drum magazine assembly 50 is shown in FIGS. 11-20. The drum magazine assembly 50 includes a rotatable drum portion 51 having a rear plate 52 along with a circumferential wall 53, shown in FIG. 13, which encompasses the outside of the rotatable drum portion 51. A central support 54 is located on the rear plate 52 with the central support 54 having an opening 56 for a support axle 58 in order to mount the rotatable drum portion 51 to the housing 20 at the drum receiving space 34. As shown in detail in FIGS. 13-15, the rear plate 52 includes projectile receiving openings 55 located around the periphery.

A ring 60 and projectile holders 70 is connected to the rear plate 52. Each of the projectile holders 70 is configured to hold at least two projectiles 12 in a generally radially stacked configuration. In this case, the generally radially stacked configuration means that these projectiles 12 in the form of darts are stacked radially, preferably at an angle between 10 and 20° from a true radial direction defined through a center axis 59 of the rotatable drum portion 51. More preferably, the projectiles 12 are stacked at an angle of between 12 and 17° from a true radial direction, and most preferably the projectiles 12 are stacked at an angle of about 15° to a true radial direction.

Figure 14:
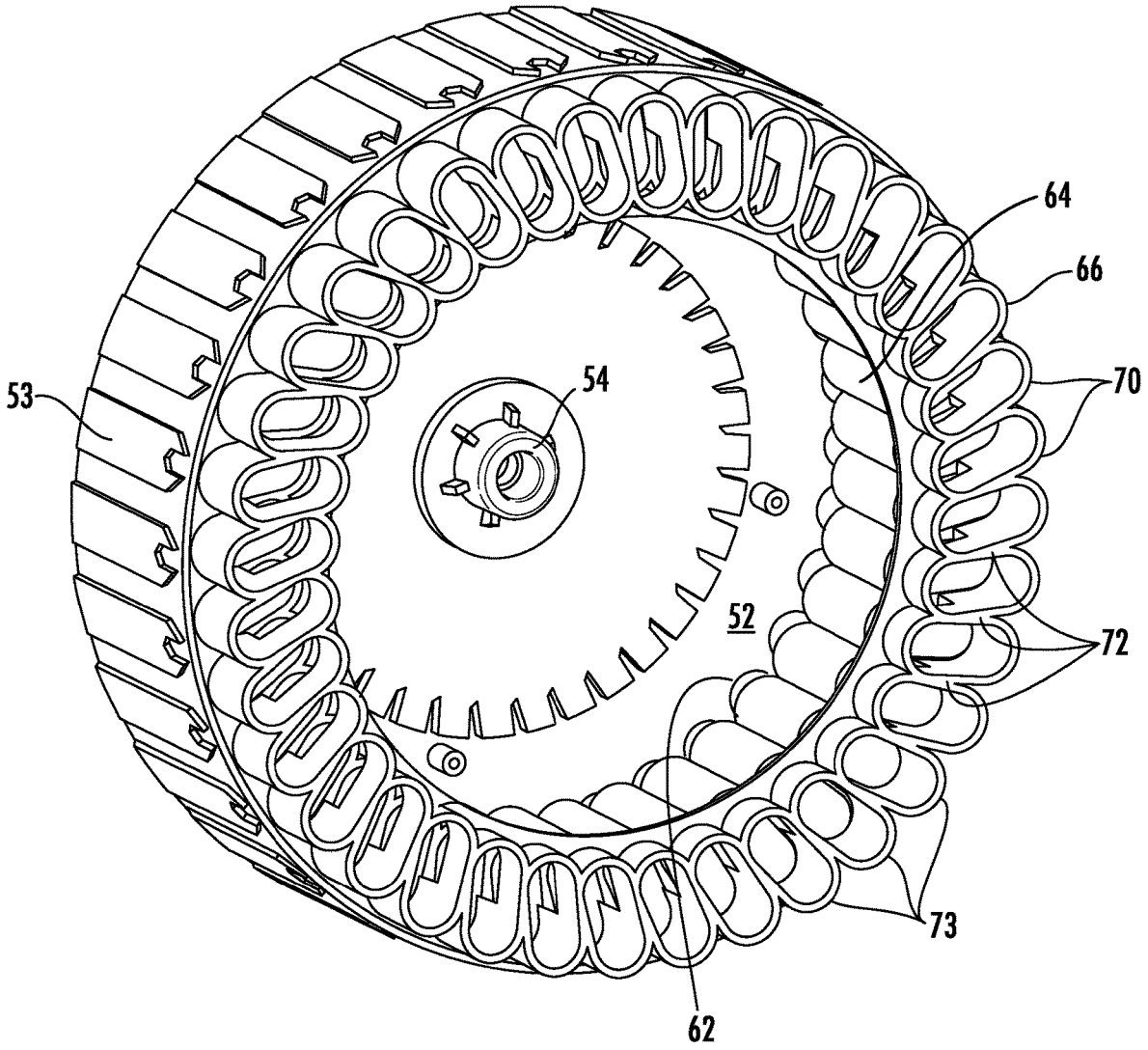
FIG. 14 is a view of the partially assembled rotatable drum portion showing the installation of the projectile holder assembly pieces.
Figure 15:
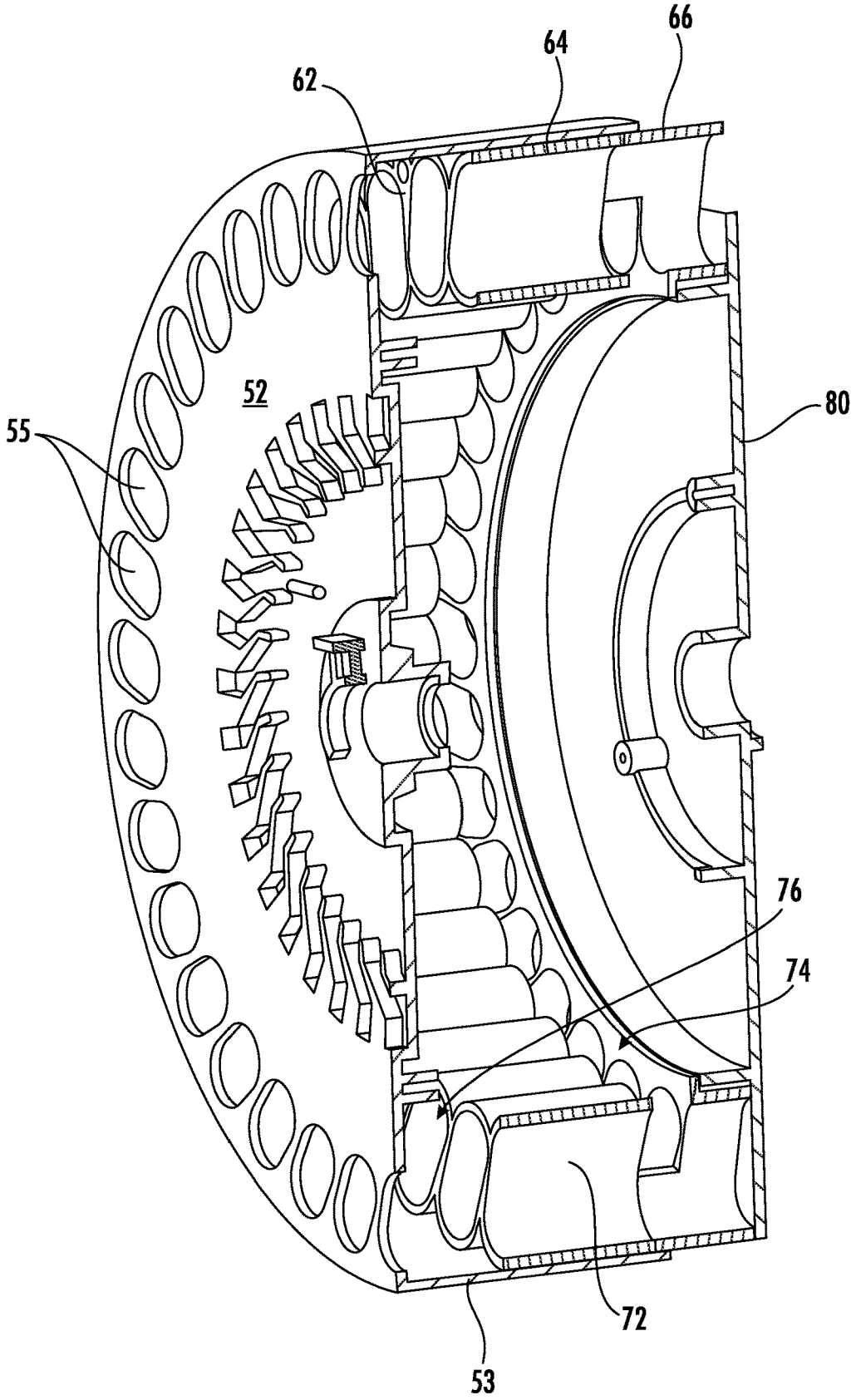
FIG. 15 is a cross-sectional view through the drum magazine assembly including the fixed front cover.

As shown in detail in FIGS. 14 and 15, the ring 60 of projectile holders 70 is preferably formed with a rear ring 62 that is adjacent to the rear plate 52, a middle ring 64 and a front ring 66. These rings 62, 64, 66 each include circumferentially arranged projectile holder portions that once assembled together are designed to accommodate the at least two projectiles 12 that are aligned with one another in the longitudinal direction, parallel to the axis 59 of the rotatable drum portion 51. Generally radially extending side walls 72 are defined by the assembled rear ring 62, middle ring 64, and front ring 66 and form the sides of each of the projectile holders 70. A top wall 73 is located between the side walls 72. A slot 74, and preferably two slots 74, 76, are located on a radially inner side 71 of each of the projectile holders 70. The slots 74, 76 are defined by the spaces formed at the intersections between the rear ring 62, the middle ring 64, and the front rings 66. While two of the slots 74, 76 are provided, it is understood that depending on the particular design a single slot could be utilized. By assembling the ring 60 of projectile holders 70 in this manner, manufacturing of the slots 74, 76 is simplified. It is noted that the rear ring 62 could be formed with the rear plate 52 as one part, as explained in the alternate embodiment of the rotatable drum portion 51' below.

Figure 11:
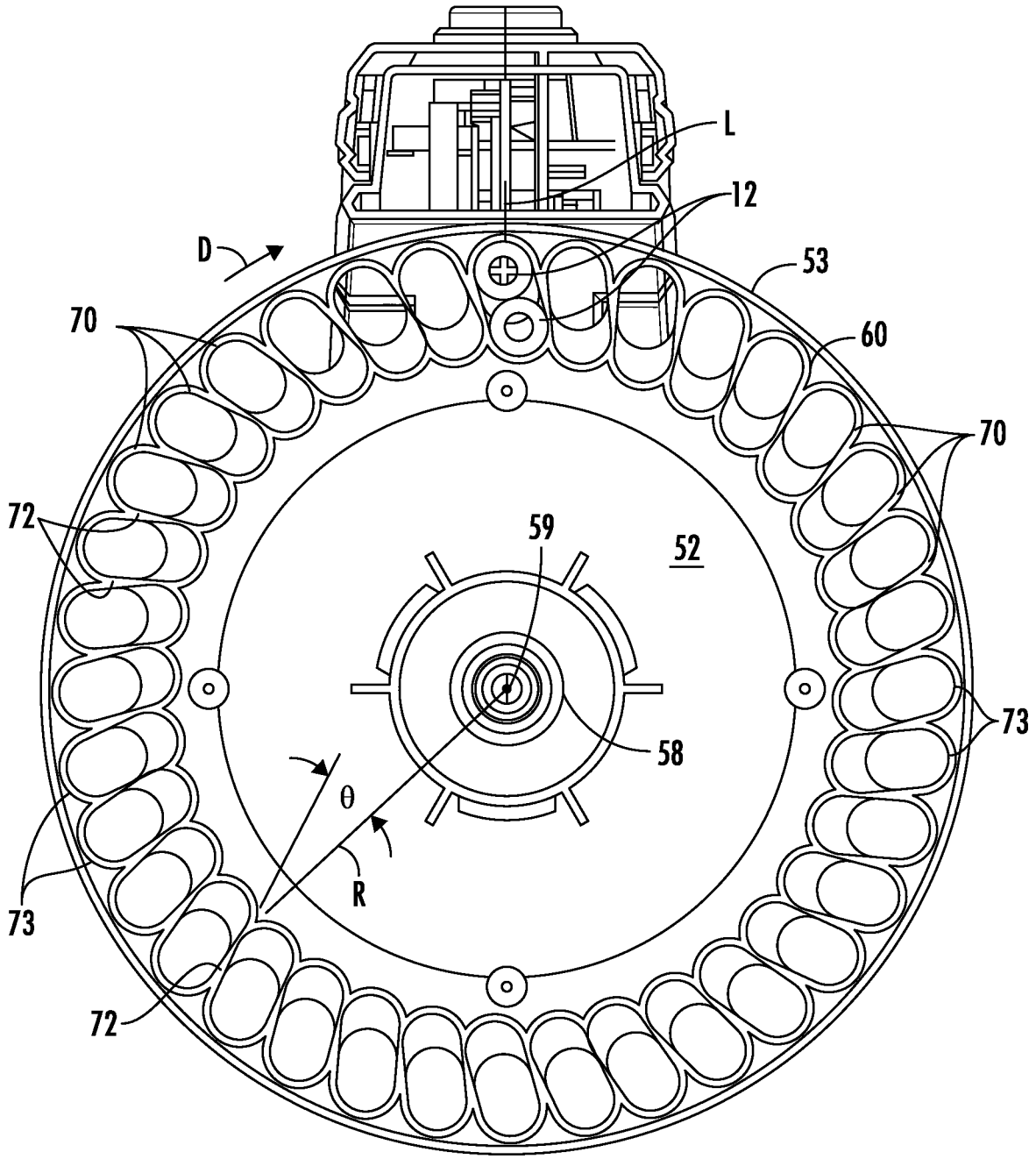
FIG. 11 is a cross-sectional view through the drum magazine assembly.
Figure 12:
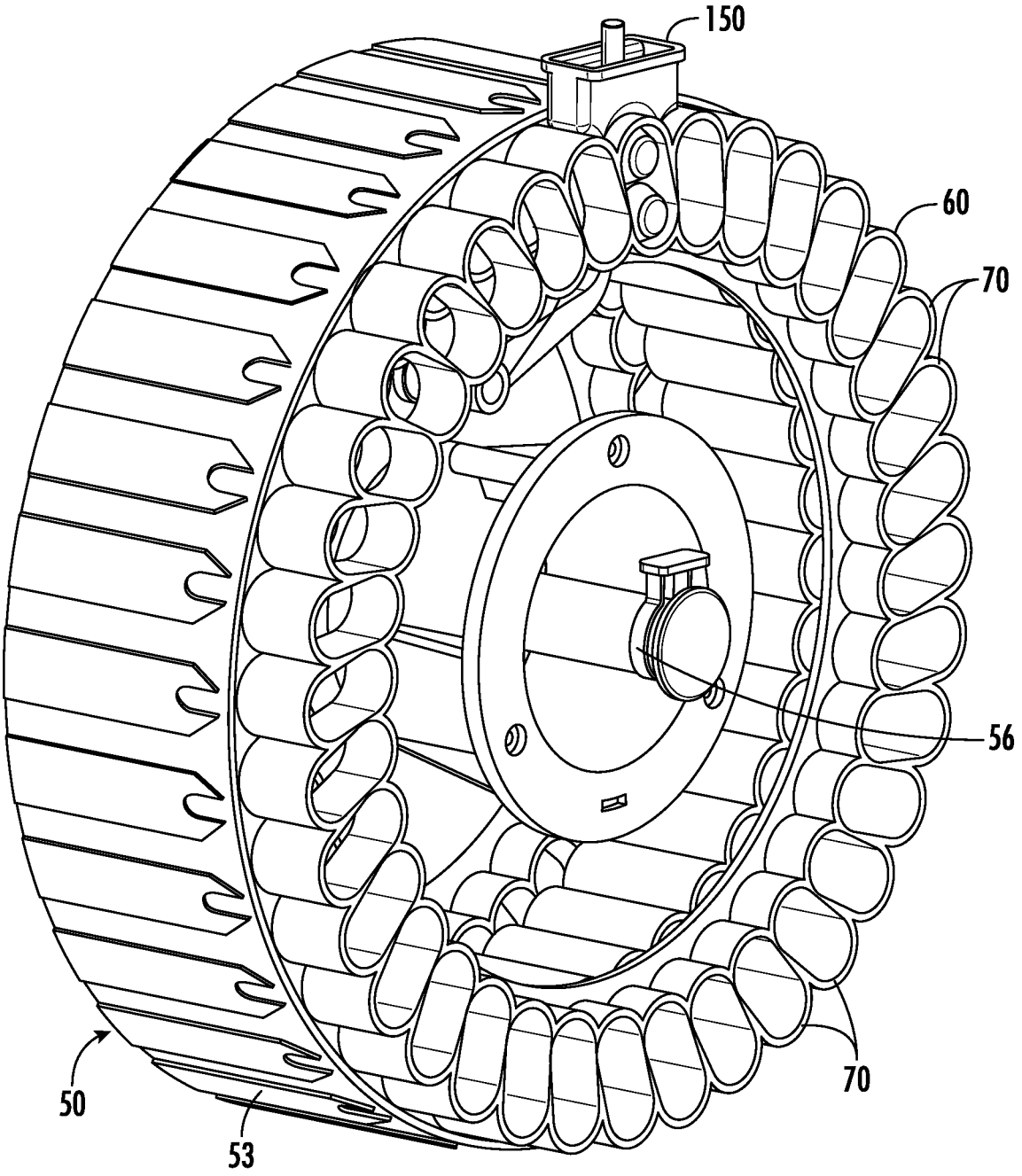
FIG. 12 is a front right perspective view of the drum magazine assembly with the (housing) fixed front cover removed.
Figure 13:
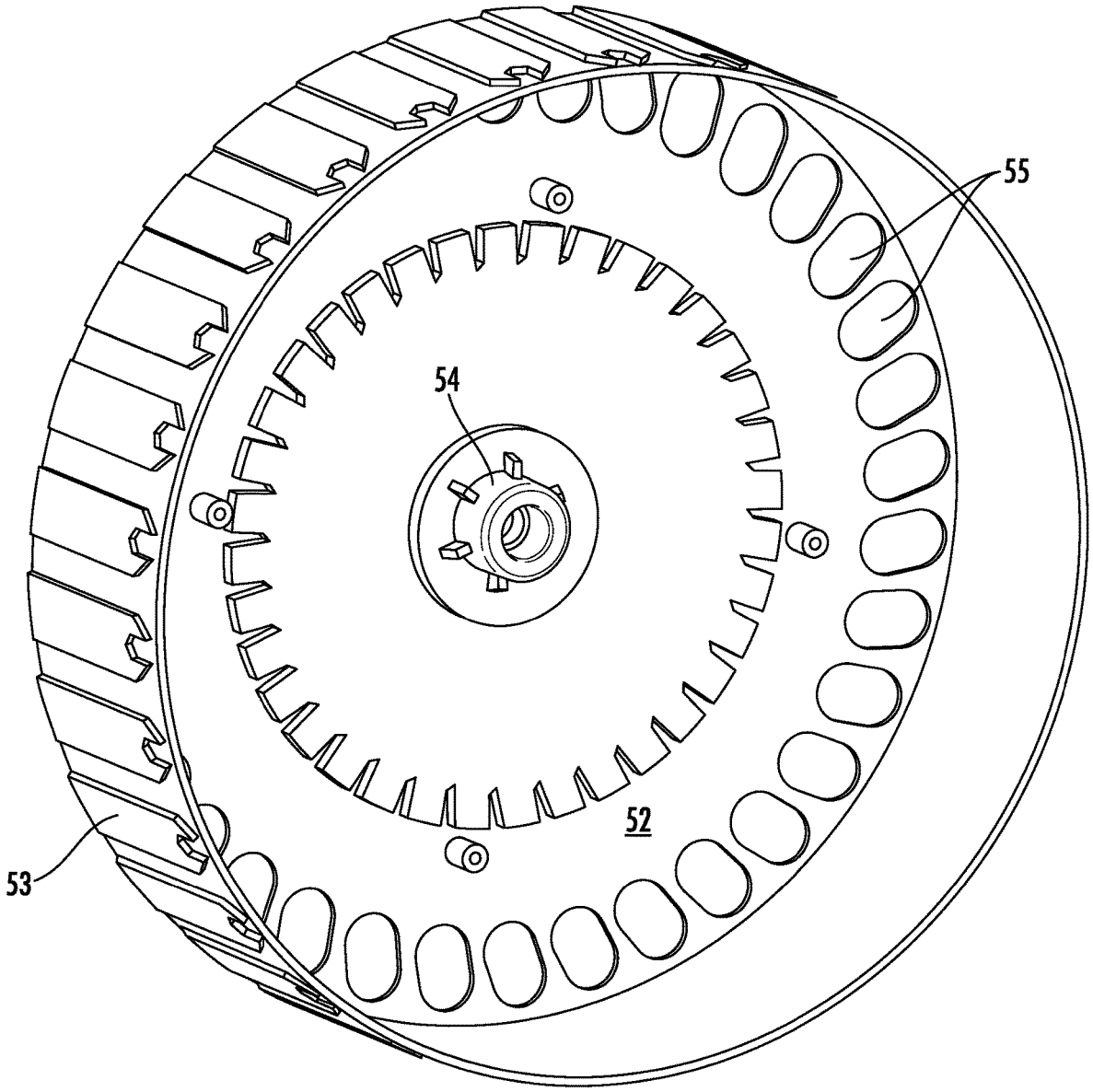
FIG. 13 is a front right perspective view of the rear plate and circumferential wall that form the outer portion of the rotatable drum portion.
Figure 16:
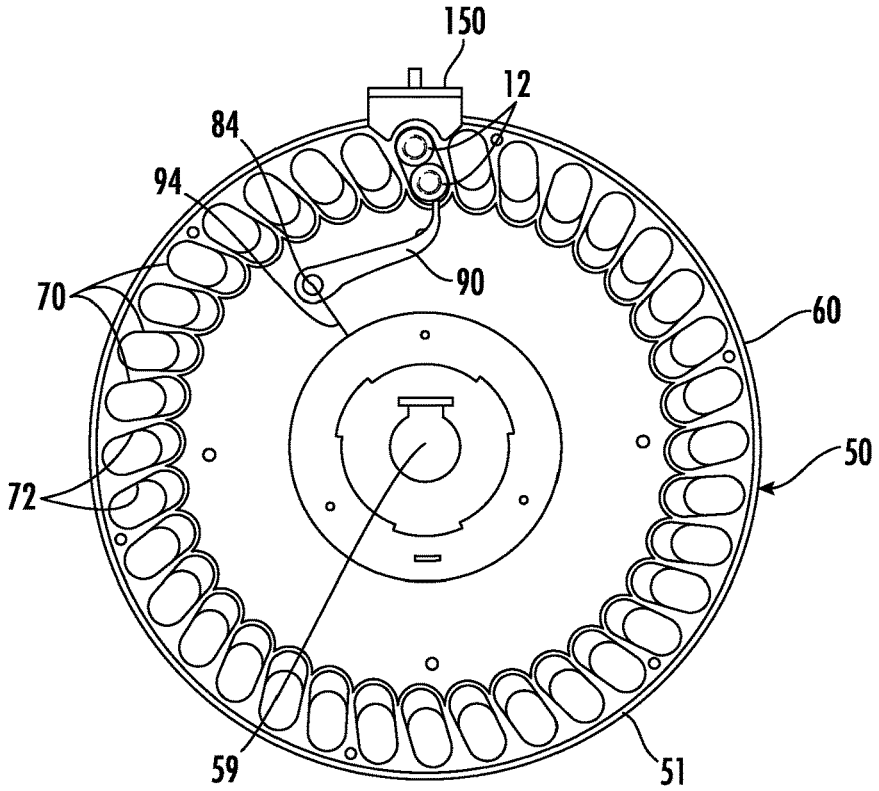
FIG. 16 is a cross-sectional view of the drum magazine assembly with the front cover removed, showing the projectile biasing arm in a first position in which two projectiles are in a projectile holder.
Figure 17:
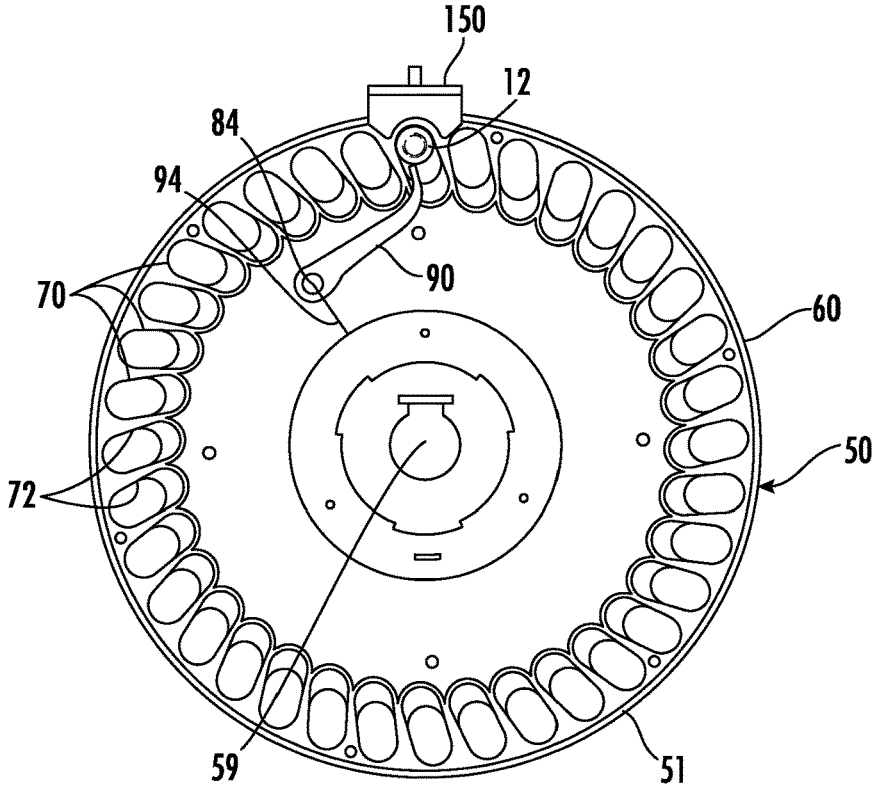
FIG. 17 is a cross-sectional view similar to FIG. 16 showing the projectile biasing arm when only a single projectile is in the projectile holder.
Figure 18:
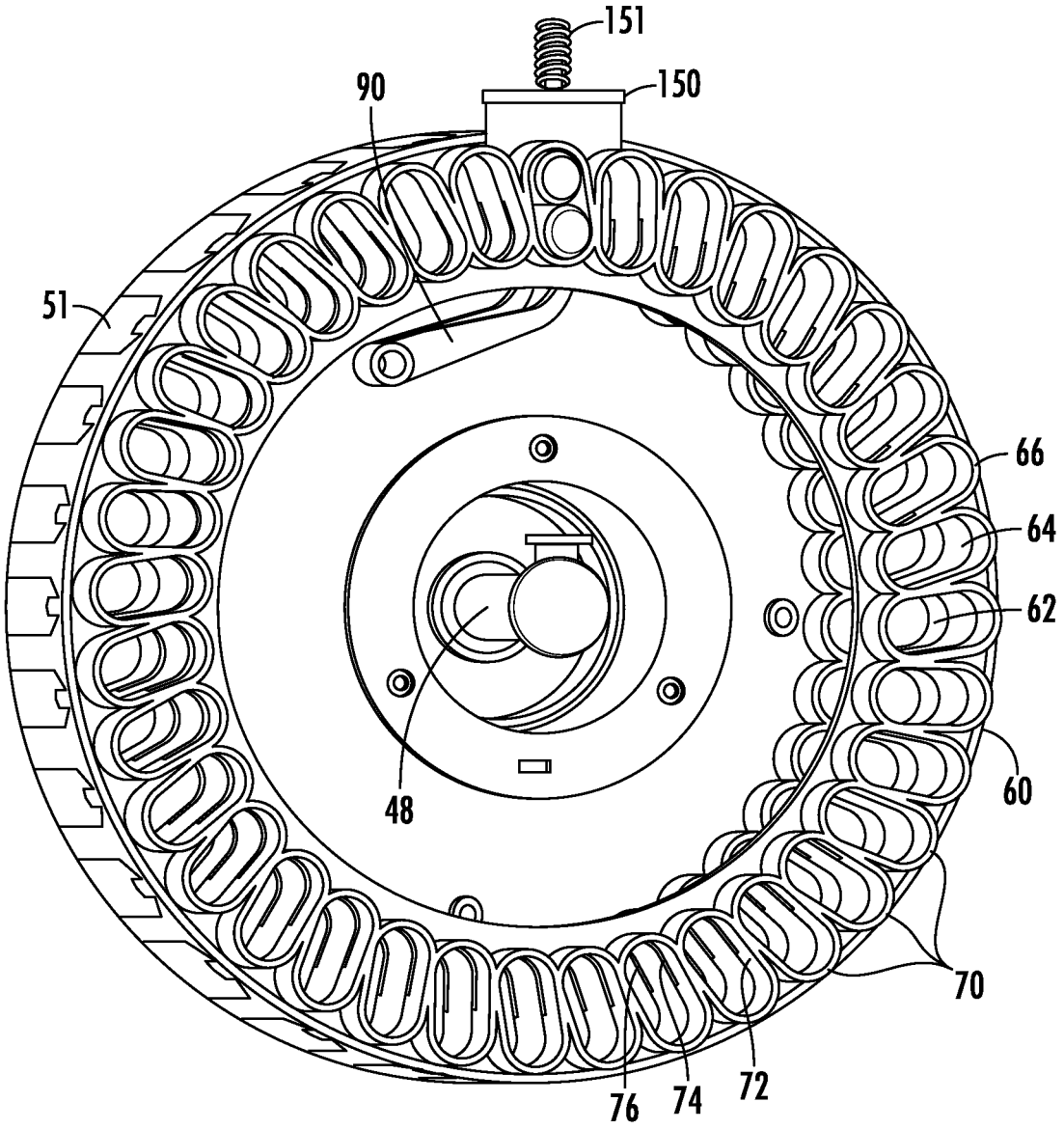
FIG. 18 is a front perspective view of the drum magazine assembly with the front cover removed.
Figure 19:
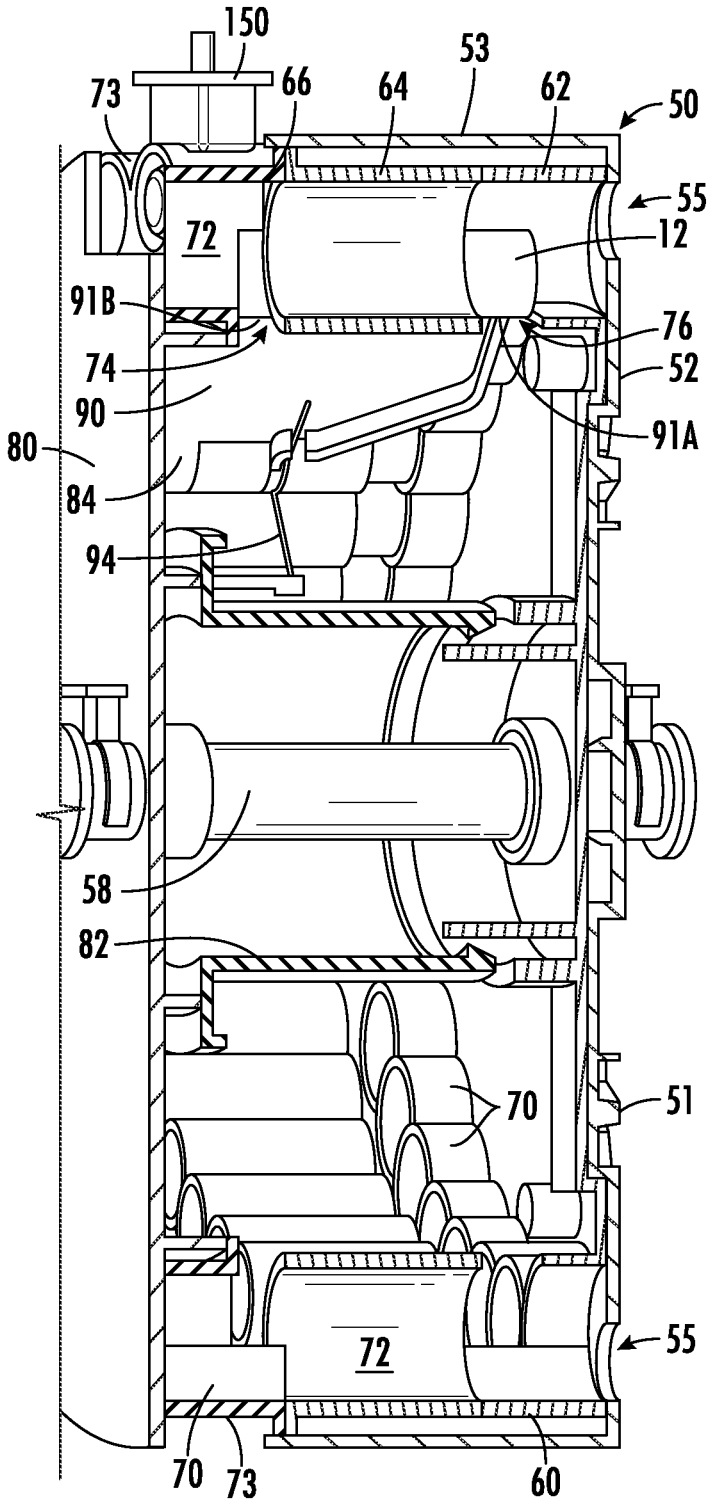
FIG. 19 is a cross-sectional view through the assembled drum magazine assembly showing the support axial and the projectile biasing arm.
Figure 20:
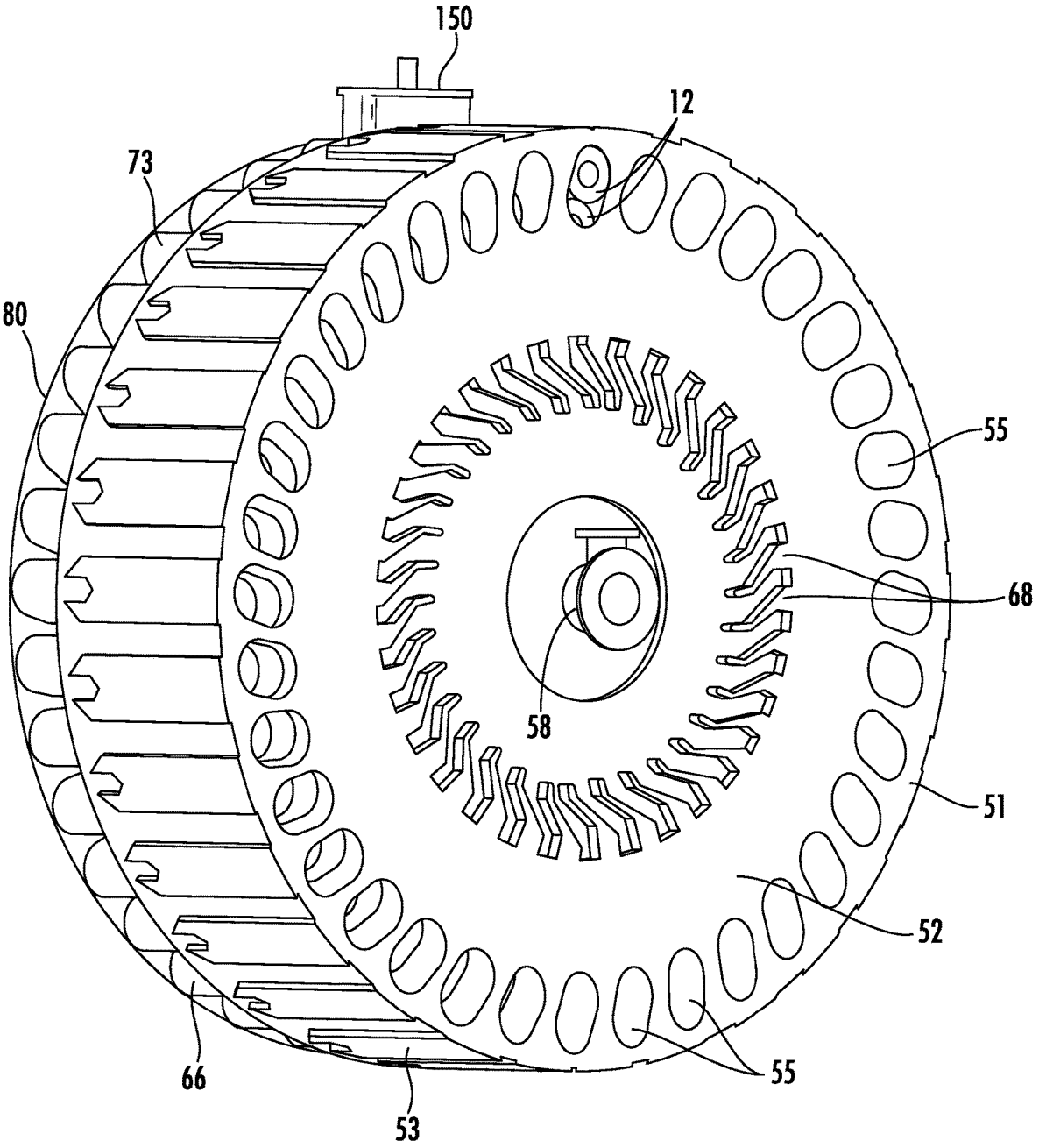
FIG. 20 is a rear perspective view of the assembled drum magazine.

As shown in detail in FIGS. 11, 16, and 17, the generally radially extending walls 72 located between adjacent ones of the projectile holder 70 are preferably angled at an angle θ between 2° and 30° from a radial direction R through a center of the rotatable drum portion 51, defined by the axis 59. More preferably, the generally radially extending walls 72 are set at an angle θ of between 10° and 20°, most preferably at an angle θ of 15° from the radial direction R. As best illustrated schematically in FIG. 11, the rotatable drum portion 51 is configured to rotate in a same direction D as an orientation of inner ends of the generally radially extending walls 72. Depending on the configuration of the projectile biasing arm 90, described in further detail below, the walls 72 could also extend in a true radial direction.

While the rotatable drum portion 51 is shown with a rear plate 51 and a rear ring 62, middle ring 64, and front ring 66, this is not required and the projectile holders 70 could be formed in other manners and joined together to form the ring 60. Preferably, the components of the rotatable drum portion are formed of injection molded plastic material.

Figure 21:
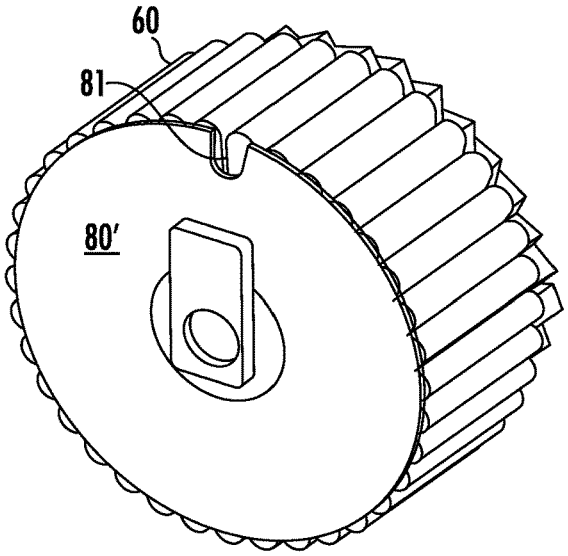
FIG. 21 is a perspective view of an alternate embodiment of the drum magazine.

As shown in FIGS. 5, 9, 15, and 19, the drum magazine assembly 50 includes a fixed front cover 80 is located in front of the projectile holders 70. This fixed front cover 80 only includes a single opening 81, best shown in FIG. 21, through which the projectiles 12 can be launched as explained in further detail below.

Figure 10:
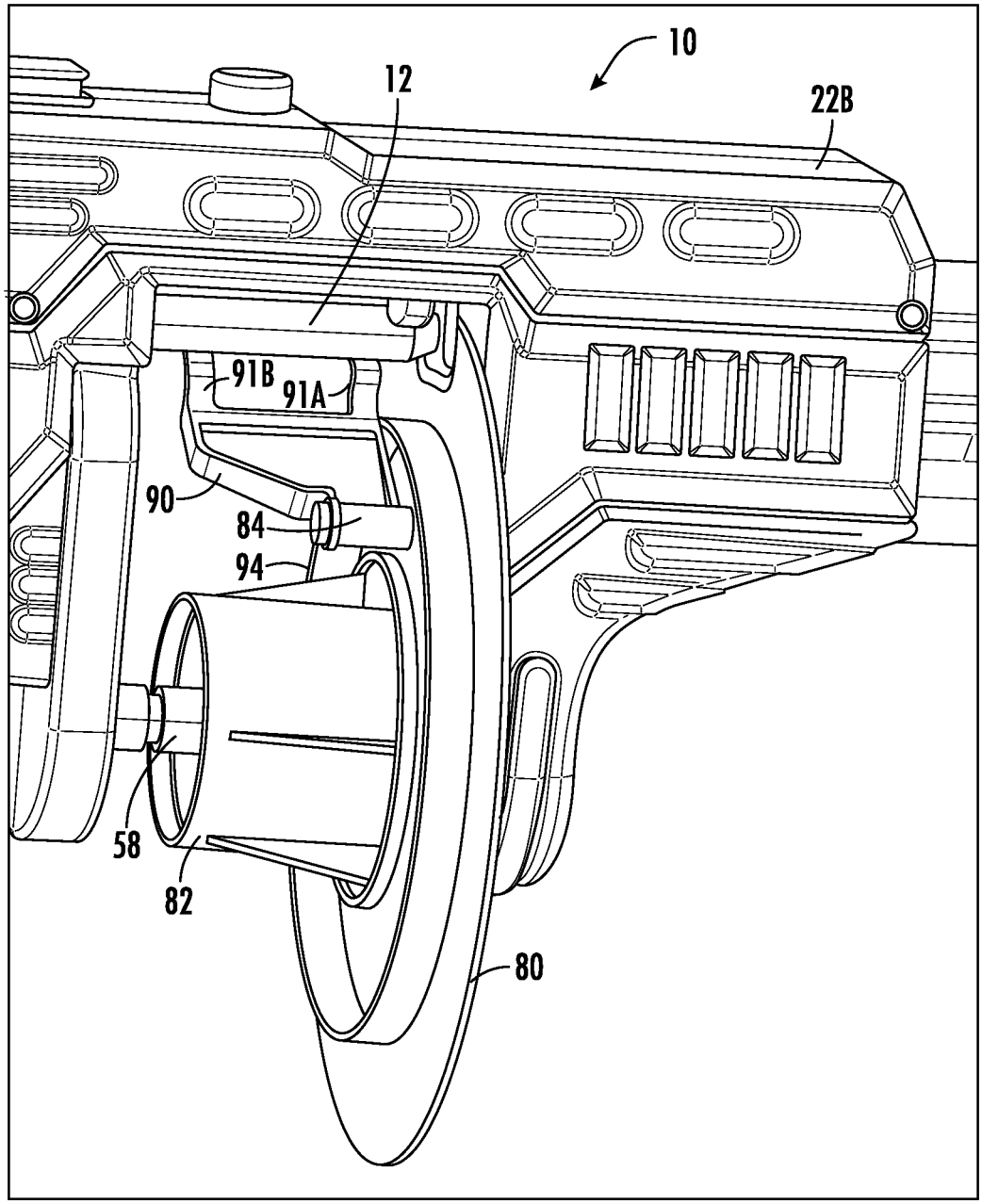
FIG. 10 is an enlarged right side perspective view with the movable part of the drum magazine assembly removed in order to show the projectile biasing arm.

As shown in FIGS. 10 and 16-19, a projectile biasing arm 90 is mounted to the fixed front cover 80 at a position at least partially within the rotatable drum portion 51. As shown in FIG. 10, the fixed front cover 80 preferably includes a hollow center core 82 as well as a post 84 on which the projectile biasing arm 90 is mounted. A spring 94 is provided in order to bias the projectile biasing arm 90 radially outwardly. The projectile biasing arm 90 extends into the at least one slot 74, preferably both slots 74, 76 on the radially inner side 71 of the projectile holders 70 at a projectile launcher position L of the rotatable drum portion 51. As shown, the projectile biasing arm 90 preferably includes two arm portions 91*a*, 91*b* such that one of the arm portions extends into each of the slots 74, 76 on the radially side 71 of the projectile holder 70 at the projectile launch position L. However, it could also be formed with only a single arm portion aligned with a single slot on the radially inner side of the projectile holders 70.

Referring to FIGS. 5-9, a pusher assembly 100 is provided including a pusher 101, preferably in the form of a rod, located in the housing 20 adjacent to the projectile launch position L of the rotatable drum portion 51, aligned with the opening 81. The pusher assembly 100 includes a slide 104 that is linearly displaceable along a guide 106, preferably formed in the housing 20, in order for the pusher 101 to advance through an opening 36 in the housing at the projectile launch position L of the rotatable drum portion 51 when the trigger 130 is activated. While a mechanical linkage can be utilized in order to move the pusher 101 based on the movement of the trigger 130, in a preferred embodiment a motor drive 108 is provided that is powered by a power source, preferably batteries located in a battery compartment 40 in the housing 20, such that upon activating the trigger 130, the pusher 101 is advanced using the motor drive 108, for example via a rack and pinion arrangement between the motor drive 108 and the pusher 101.

One or more drive wheels 120, 122 are positioned in the housing 20 in front of the drum magazine assembly 50 at the projectile launch position L. Preferably, two of the drive wheels 120, 122 are provided as shown in FIGS. 5-9, and are located in a drive housing 118. At least one motor 124, 126 is connected to the drive wheels 120, 122. Preferably two of the motors 124, 126 are provided with one of the motors being connected to each of the respective drive wheels 120, 122. The drive wheels 120, 122 are configured to rotate upon the at least one motor 124, 126 being activated, preferably using the trigger 130, in order to propel at least one of the projectiles 12 when pushed by the pusher 101 from the drum magazine assembly 50 toward the one or more drive wheels 120, 122 for launching the at least one of the projectiles 12 out of the toy launcher 10 through the barrel 32. In one preferred arrangement, the at least one motor 124, 126 is activated when the trigger 130 is pulled a first incremental distance, connecting the at least one motor 124, 126 to the batteries located in the housing 20.

Referring again to FIGS. 5-9, the trigger 130 is movably connected to the housing 20, such that activation of the trigger, for example by slidingly moving the trigger rearwardly within the trigger guard 28 causes an incremental rotation of the rotatable drum portion 51 and activates the pushes 101 such that the pushing rod 102 that is in alignment with a respective one of the projectile holders 70 in the projectile launch position L extends through the opening 36 in the housing 20 to mechanically push an outer most of the projectiles 12, that is biased radially outwardly by the projectile biasing arm 90 acting on the outer most projectile 12 or an a radially inner one of the projectiles 12 in the respective one of the projectile holders 72 (see FIG. 29) when loaded in the respective one of the projectile holder 70, through the opening 81 in the fixed front cover 80 to engage of the one or more drive wheels 120, 122, in order to launch the first projectile 12.

In order to advance the drum 50, a drum advancement assembly 140 is provided with a drum advancement arm 142 that is configured for reciprocal movement as shown in detail in FIGS. 5 and 7-9. The drum advancement arm 142 includes a drive surface 144 on one end and, as shown in detail in FIGS. 3 and 15, and the rear plate 52 of the drum 50 includes an arrangement of cam slots 68 in which the drive surface 144 is engaged. As shown in FIG. 7, a slidable projection 109 that moves rearwardly as the pusher 101 is fully withdrawn into the housing is also powered by the pusher assembly motor drive 108 and is configured to engage a lever portion 148 that extends on the opposite side of the pivot point 149 from the drum advancement arm 142 in order to move the drive surface upwardly to engage into the cam slot 68 and rotate the rotatable drum portion 51

The cam slots 68 in the rear plate 52 are equally spaced in a circle and the number of cam slots 68 equals the number of projectile holders 70. Movement of the drum advancement arm 142 in each cam slot 68 incrementally advances the drum 50 in a circumferential direction D in order to bring a next adjacent one of the projectile holders 70 into the launch position L. The drum advancement arm 142 can be linked to the trigger by mechanical linkage, or more preferably is driven via the drive motor 108 for the pusher assembly 100 in order to advance each time the pusher assembly 100 is activated after the pusher 101 retreats back through the opening 36 in the housing 20, such that by a user holding the trigger 130 in a fully activated position, repeated firing of the toy projectiles 12 can be carried out via the pusher assembly motor drive 108 reciprocating the pusher 101 and the drive advancement assembly 140 sequentially advancing the moveable part of the drum 50 via the drive surface 144 at one end of the drum advancement arm 142 engaging in the cam slots 68.

As shown in detail in FIGS. 12 and 16-18, a detent mechanism 150 provides for indexing of the movable part of the drum 50 by engaging on the radially outer top wall 73 that extends past the front of the circumferential wall 53 of each of the projectile holders 70 in order to ensure that the projectile holder 70 at the launch position L is aligned in the proper position with the pusher 101, the opening 81 in the fixed front cover 80, and the space between the drive wheels 120, 122. The detent mechanism can be biased by a spring 151, shown in FIG. 18, to engage the top wall 73.

Figure 5:
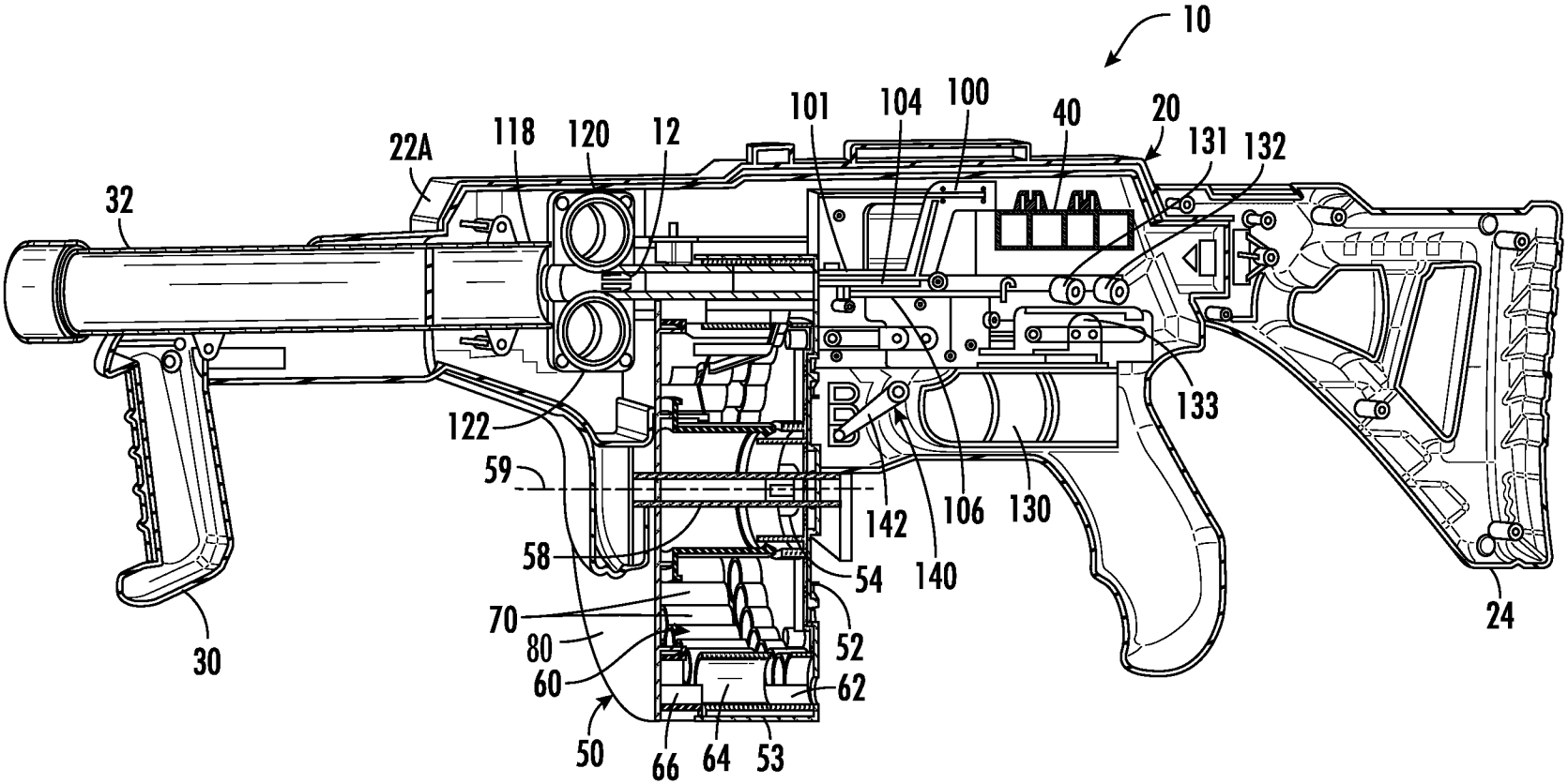
FIG. 5 is a left side view of the toy launcher, shown with the left housing half removed and the drum magazine assembly in cross-section.
Figure 6:
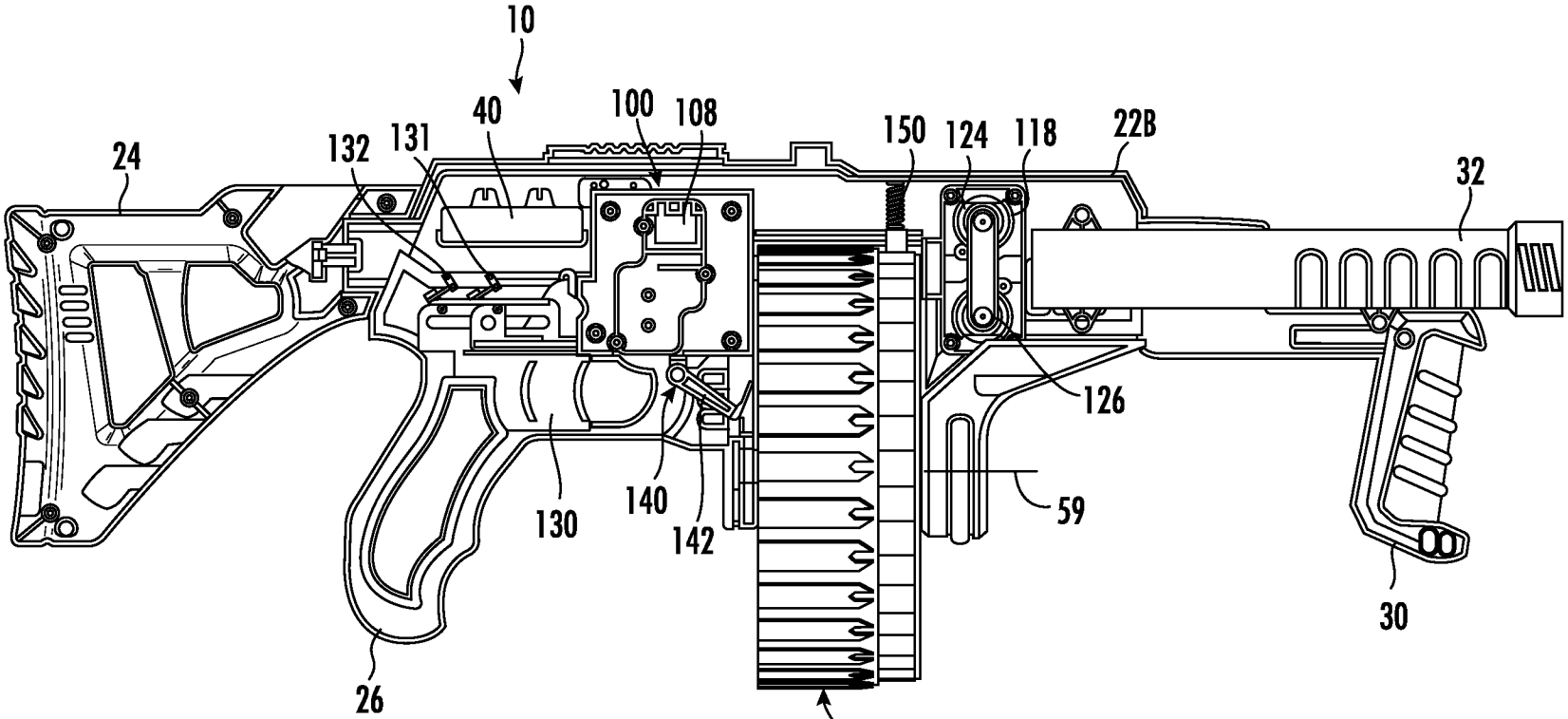
FIG. 6 is a right side elevational view of the toy launcher with the right housing half removed showing the inner components.

As shown in FIG. 5, the trigger 130 is preferably slidably mounted in the housing 20, and two switches 131, 132 are mounted along the trigger path. A projection 133 on the trigger 130 contacts the first switch 131 when it is pulled about halfway. This position preferably activates the at least one motor 124, 126 for the drive wheels 122, 124. Further pulling on the trigger such that the projection 133 contacts the second switch 132 preferably activates the motor drive 108 for the pusher assembly 100 and the drum advancement assembly 140.

Figure 29:
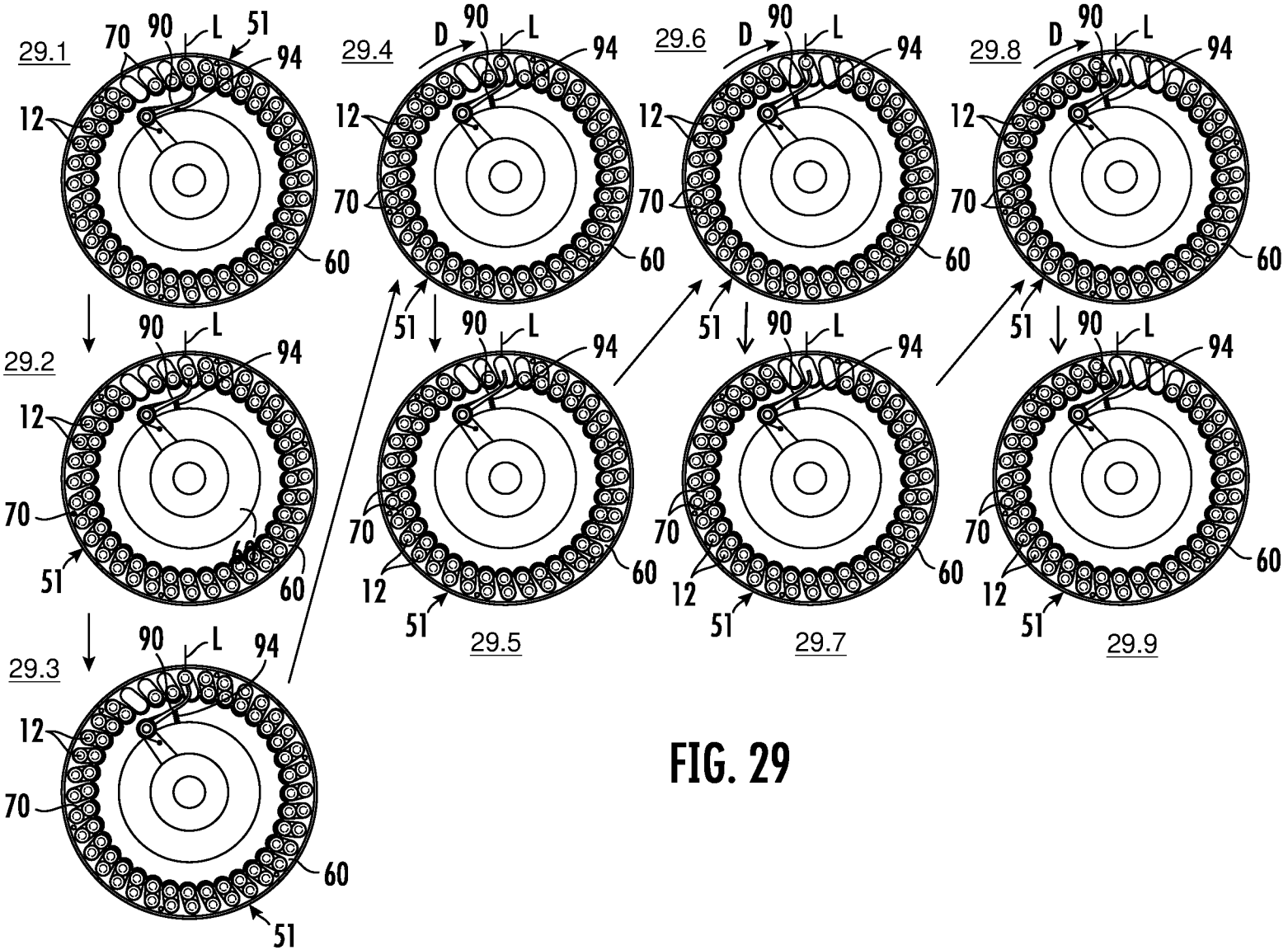
FIG. 29 is a schematic view showing a sequence of movement of the drum magazine with the projectile biasing arm moving the toy projectiles radially outwardly at the projectile launch position.

As shown in FIG. 29, which illustrates through a series of steps the action of the projectile biasing arm 90, in a first position 29.1, the projectile biasing arm 90 is biasing against the inner-most projectile 12 of two projectiles located in the projectile holders 72 at the projectile launching position L. The pusher 101 is activated, preferably continuously by fully pressing in the trigger 130, in order to advance the projectile 12 between the drive wheels 120, 122 for launching. As shown at 29.2, after the first dart is fired, the projectile biasing arm 90 moves what was the previously radially inner located one of the darts 12 radially outwardly while at the same time the rotatable drum portion 51 is rotated in the advancement direction D by the drum advancement assembly 140, as shown at 29.1-29.4. Here, the next adjacent one of the projectile holders 72 only included a single projectile 12 in the form of a dart which was in the radially inward position (see 29.1-29.3) is biased radially outwardly as the drum 50 rotates so that this next adjacent projectile holder 70 is in the projectile launch position (see 29.4). Here, the projectile 12 in the form of the dart is biased radially outwardly to the launch position and the pusher 101 is activated, preferably continuously by holding the trigger 130 inwardly, in order to advance the projectile 12 between the drive wheels 120, 122 for launching. As shown at 29.5, as the rotatable drum portion 51 is advanced by the drum advancement assembly 140, the projectile biasing arm 90 biases the projectile in the form of a dart 12 from the next adjacent one of the projectile holder 72 radially outwardly to the launch position L where the projectile biasing arm 90 holds this next projectile 12 in the launch position (see 29.6) where the pusher 101 again advances to push the projectile 12 between the drive wheels 120, 122 for launching. As shown at 29.7 and 29.8, while there is no projectile 12 in the next adjacent one of the projectile holders 70, if the trigger 130 is held in order to provide continuous activation, the pusher 101 is advanced even though there is no projectile 12 to be fired until the drum advancement assembly 140 advances the drum 50 to the next position as shown at 29.9.

In this configuration, the rotatable drum portion 51 is adapted to complete a full revolution while launching an outer most one of the projectiles 12 from each of the projectile holders 70 prior to the radially inner ones of the projectiles 12 (if present) being moved radially outwardly by the projectile biasing arm 90 at the projectile launch position L for launching during a subsequent revolution of the drum 50.

Figure 30:
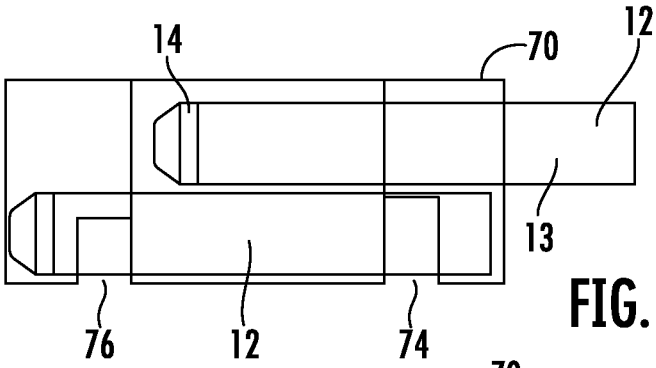
FIG. 30 is a schematic view showing the installation of toy projectiles in the form of darts into a projectile holder designed to accommodate two such darts in a radially spaced manner.
Figure 31:
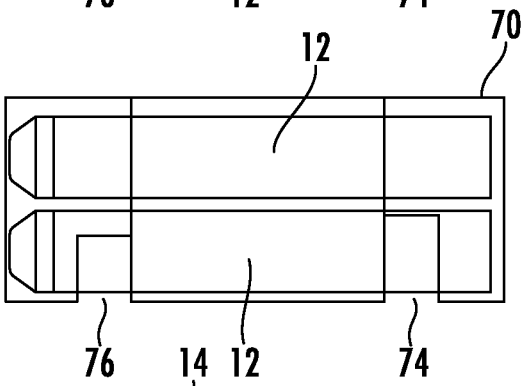
FIG. 31 is a view similar to FIG. 30 showing two darts installed into a projectile holder.

FIGS. 30 and 31 schematically show loading one projectile holder 70 with two darts and also show the slot 74, 76 on a radially inner side 71 of the projectile holder 70. With this configuration for each of the projectile holders 70, two complete revolutions of the rotatable drum portion 50 would be required in order to launch all of the projectiles. Depending on the dart size and the drum diameter the number of projectiles 12 that can be loaded into the drum magazine assembly 50 can be varied. One preferred arrangement provides for 36 projectile holders 70 with each capable of receiving two of the projectiles 12 such that 72 of the projectiles 12 can be loaded in the drum magazine assembly 50.

Figure 32:
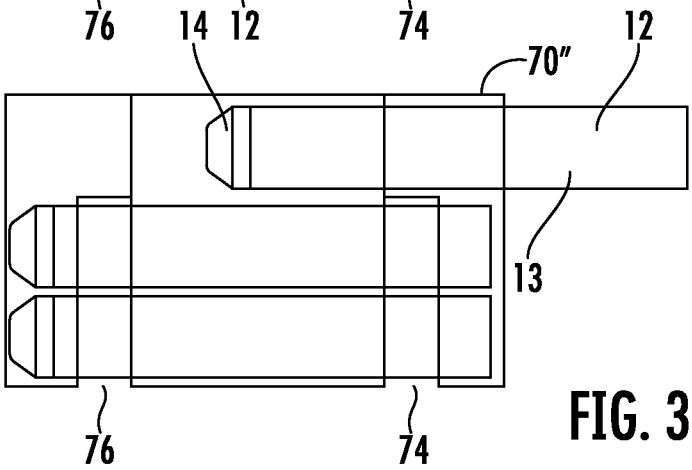
FIG. 32 is a schematic view similar to FIG. 30 showing a projectile holder designed to accommodate three toy darts and showing the insertion of the third toy dart into the projectile holder.
Figure 33:
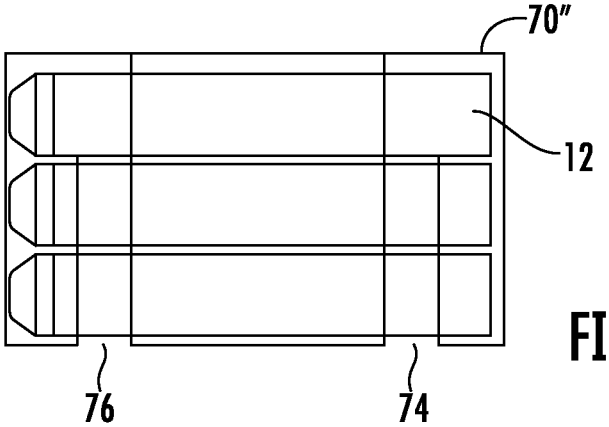
FIG. 33 is a schematic view showing three toy darts installed in a projectile holder.

In an alternative arrangement shown in FIGS. 32 and 33, each projectile holder 70" is configured to hold three of the projectiles 12 in the form of darts. Here, the capacity of the drum magazine assembly 50 can be increased for example to hold 108 darts if 36 projectile holders 70" are utilized. However, the number of projectile holders 70" could be varied depending on the overall diameter of the drum 50 that is practical for the particular application. As shown in FIGS. 32 and 33, the slots 74, 76 extend through the position of the inner-most two projectiles 12 such that the projectile biasing arm 90 can press each of the three projectiles 12 loaded into the projectile holder 70" radially outwardly to the launch position L. In this case, three complete revolutions of the movable drum portion 51 would be required in order to launch all of the projectiles if the drum magazine assembly 50 were fully loaded.

In this embodiment, the drum magazine assembly 50 or at least the rotatable drum portion 51 is removable from the housing 20 by having the support axle 58 slidable in the axial direction out from the housing 20. However, it would also be possible to have the drum magazine assembly 50 non-removably mounted to the housing 20.

FIGS. 21-28 show an alternate embodiment of the drum magazine assembly 50'. Similar elements are identified with the same element numbers with an added prime, so that the rear plate 52' is similar to the rear plate 52 described above. The drum magazine assembly 50' also uses the projectile biasing arm 90'. Here the fixed front cover 80' includes the hollow center core 82' having a projective biasing arm support 83' that extends radially outwardly. In this case, the projectile biasing arm 90' is held to the support via a pin 92'. The spring 94' is still provided for biasing the projectile biasing arm 90' radially outwardly. Here, the projectile biasing arm 90' still includes two arm portions 91*a*', 91*b*' that extend into the slots 74', 76'.

The rotatable drum portion 51' includes the rear plate 52' with the circumferential wall 53'. Here, the rear ring 62 used to form the projectile holders 70' is omitted, and the rear portions of the projectile holders 70' are integrated with the rear plate 52'. The middle ring 64' and front ring 66' that form the projectile holders 70' are similar to the corresponding parts described above, so that once assembled, the ring 60' of projectile holders 70' is formed including the slots 74' and 76' for the projectile biasing arm 90'.

Figure 23:
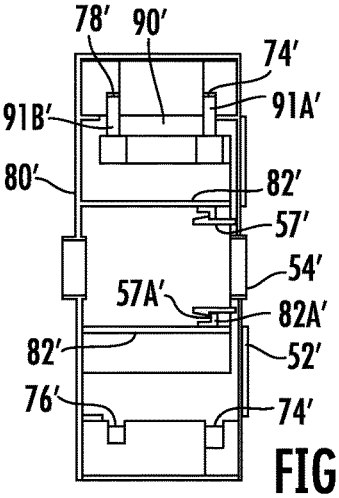
FIG. 23 is a cross-sectional view through the drum magazine assembly shown in FIG. 22.
Figure 22:
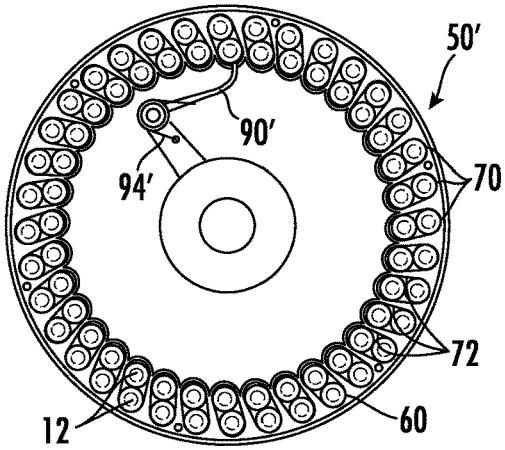
FIG. 22 is a front view of the alternate embodiment of the drum magazine assembly with the front cover removed.
Figure 24:
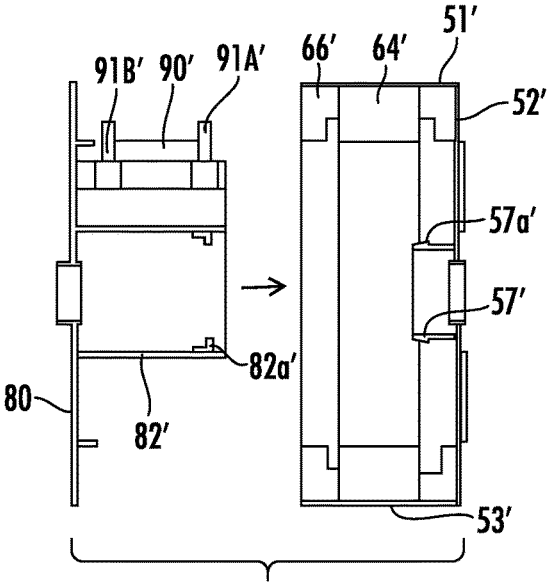
FIG. 24 is a view showing the installation of the rotatable drum portion on the fixed part of the drum magazine assembly.
Figure 25:
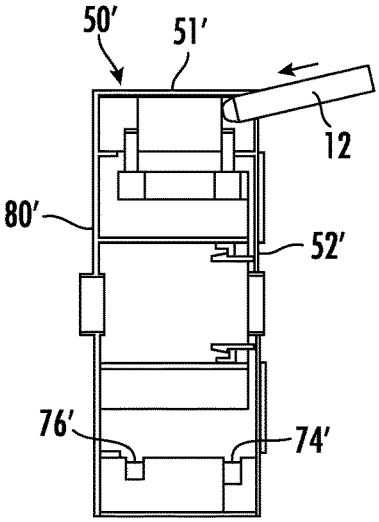
FIG. 25 is a cross-sectional view showing the loading of a projectile into the drum magazine.

FIG. 23 is a cross-section through the assembly showing the fixed front cover 80' as well as the rear plate 52' that includes a center cylindrical portion 57' having clips 57*a*' that can engage behind projections 82*a*' inside the hollow center core 82' of the fixed front cover 80', as shown in FIGS. 23 and 24 in order to maintain the axial position of the movable drum portion 51' relative to the fixed front cover 80'.

Figure 26:
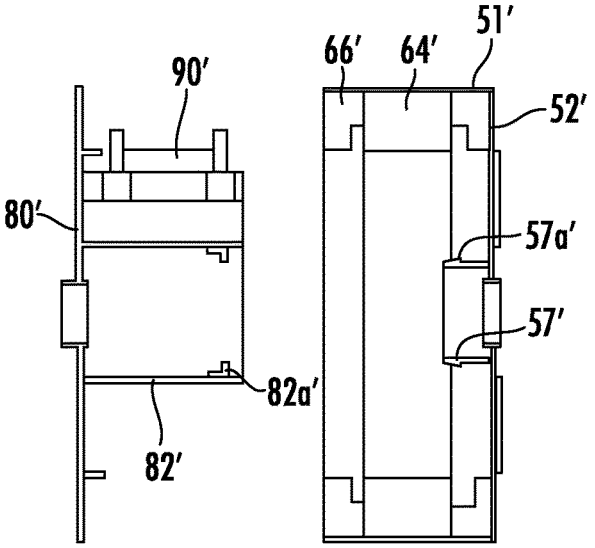
FIG. 26 shows the fixed and movable components of the drum magazine of FIG. 22 prior to assembly.
Figure 28:
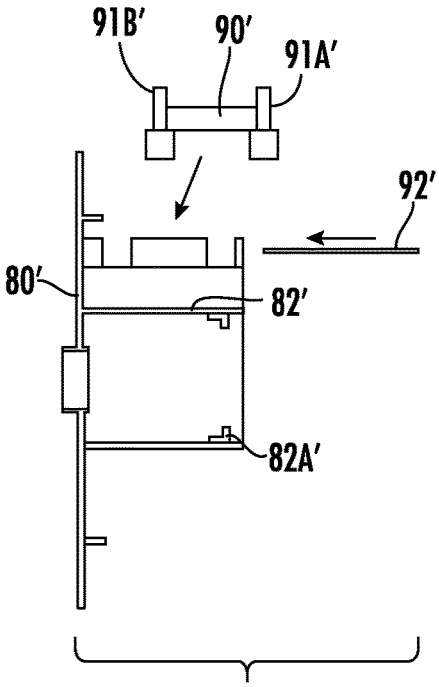
FIG. 28 is a schematic view showing the assembly of the fixed part of the drum magazine assembly of FIG. 22.
Figure 27:
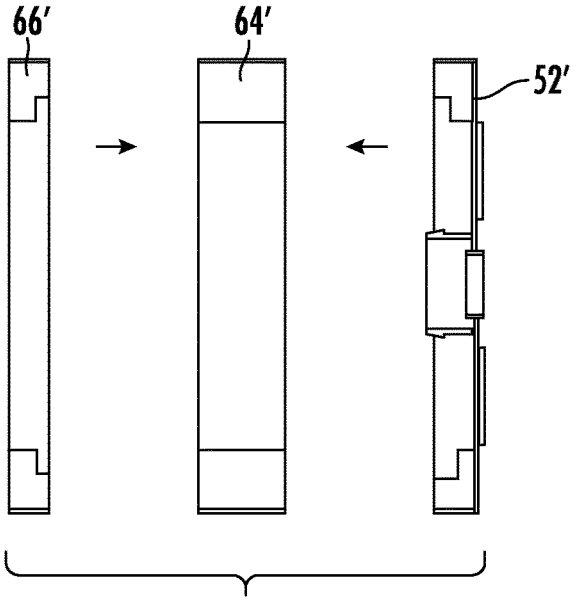
FIG. 27 is a schematic view illustrating the assembly of the drum portion.

FIGS. 26 and 28 show the assembly of the projectile biasing arm 90' to the fixed front cover 80' using the pin 92' while FIGS. 26 and 27 show the assembly of the movable drum portion 51' including the rear plate 52' along with a middle ring 64' and a front ring 66' that are assembled together in order to form the ring 60' of projectile holders 70' connected to the rear plate 52'

In a preferred embodiment, the projectile 12 is a dart having an elongate body 13 with a cap 14 affixed to the dart body, and the cap 14 is configured to enable the dart to travel relatively accurately toward a target, while still contacting the target in a safe manner. The darts are loaded into the drum magazine assembly 50 from the rear side as shown, for example in FIGS. 25, 30, and 32.

The motors 124, 126 for the drive wheels 120, 122 are preferably actuated by pulling the trigger 130 a first incremental amount. The motor drive 108 for the pusher assembly 100 as well as the drum advancement assembly 140 is activated when the trigger 130 is pulled a further amount to its rear most position.

In use, the projectiles 12 are loaded into the drum 50 from the rear side and the trigger 130 is partially pulled in order to activate the motors 124, 126 for the drive wheels 120, 122. Pressing the trigger 130 fully starts the motor drive 108 for the pusher assembly 100 as well as the drum advancement assembly 140 in order to rotate the rotatable drum portion 51 and push a projectile 12 at the projectile launch position L into the space between the drive wheels 120, 122 such that the projectile 12 is launched through the barrel 32 and out from the toy launcher 10. Holding the trigger 130 in the fully pressed position will allow projectiles 12 to shoot continuously by sequentially activating the pusher assembly 100 and the drum advancement assembly 140.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A toy launcher for launching projectiles, comprising:

a housing;

a drum magazine assembly connected to the housing, the drum magazine assembly having:

a rotatable drum portion with a rear plate, a central support on the rear plate, the central support having an opening for a support axle, a ring of projectile holders connected to the rear plate, each said projectile holder configured to hold at least two projectiles arranged in a generally radially stacked configuration, with generally radially extending walls located between adjacent ones of the projectile holders, and each of the projectile holders including a slot on a radially inner side thereof;

a fixed front cover located in front of the projectile holders; and a projectile biasing arm mounted to the fixed front cover at a position at least partially within the drum portion, the projectile biasing arm extending into the slots on the radially inner side of the projectile holders at a projectile launch position of the drum;

a pusher located in the housing adjacent to the projectile launch position of the rotatable drum portion;

one or more drive wheels positioned in the housing in front of the drum magazine assembly at the projectile launch position, at least one motor connected to the drive wheels, the drive wheels being configured to rotate upon the at least one motor being activated to propel at least one of the projectiles when pushed by the pusher from the drum magazine assembly toward the one or more drive wheels for launching the at least one of the projectiles out of the toy launcher.

2. The toy launcher of claim 1, wherein the generally radially extending walls located between adjacent ones of the projectile holders are angled between 2 and 30 degrees from a radial direction through a center of the drum.

3. The toy launcher of claim 2, wherein the drum is configured to rotate in a same direction as an orientation of inner ends of the generally radially extending walls which are angled between 2 and 30 degrees from the radial direction.

4. The toy launcher of claim 2, wherein each of the projectile holders includes two of the slots on the radially inner side thereof, and the projectile biasing arm includes two arm portions that extend into the slots on the radially inner side of the projectile holders at the projectile launch position.

5. The toy launcher of claim 1, wherein the one or more drive wheels includes two drive wheels positioned in the housing in front of the drum magazine assembly at the projectile launch position.

6. The toy launcher of claim 1, wherein each of the drive wheels is driven by a separate electric motor.

7. The toy launcher of claim 1, further comprising a trigger movably connected to the housing, such that activation of the trigger causes an incremental rotation of the drum and activates the pusher to push a pushing rod that is in alignment with a respective one of the projectile holders in the projectile launch position to mechanically push an outermost of the projectiles, that is biased radially outwardly by the projectile biasing arm acting on the outermost projectile or on a radially inner one of the projectiles in the respective one of the projectile holders that is located radially inwardly from the outermost projectile when loaded in the respective one of the projectile holders, such that the outermost of the projectiles contacted by the pushing rod is moved into engagement with the one or more drive wheels to launch the projectile.

8. The toy launcher of claim 1, further comprising a drum advancement arm configured for reciprocal movement and including a drive surface one end, and the rear plate of the rotatable drum portion including an arrangement of cam slots, wherein the drive surface of the drum advancement arm is engageable in the cam slots to incrementally advance the rotatable drum portion in a circumferential direction in order to bring a next-adjacent one of the projectile holders into the projectile launch position.

9. The toy launcher of claim 8, wherein the rotatable drum portion is configured to complete a full revolution while launching an outermost one of the projectiles from each of the projectile holders prior to radially inner ones of the projectiles being moved radially outwardly by the projectile biasing arm at the projectile launch position for launching during a subsequent revolution of the drum.

10. The toy launcher of claim 8, wherein the drum advancement arm is motor-driven.

11. The toy launcher of claim 1, wherein each said projectile holder is configured to hold three projectiles arranged in a generally radially stacked configuration.

12. The toy launcher of claim 1, wherein the projectiles are toy darts.

13. The toy launcher of claim 1, wherein the drum is non-removable from housing.

14. The toy launcher of claim 1, wherein the plurality of projectile holders are adapted to hold toy darts in a generally radially stacked configuration.

* * * * *